US009028383B2

(12) United States Patent
Carrasca et al.

(10) Patent No.: US 9,028,383 B2
(45) Date of Patent: May 12, 2015

(54) CORABLE CONTAINERS AND ACCESSORIES

(71) Applicant: Bucky, Inc., Seattle, WA (US)

(72) Inventors: Robert Carrasca, Seattle, WA (US); Jasmine Reese, Renton, WA (US); Jason Woodrow, Seattle, WA (US)

(73) Assignee: Bucky, Inc., Seattle, WA (US)

( * ) Notice: Subject to any disclaimer, the term of this patent is extended or adjusted under 35 U.S.C. 154(b) by 0 days.

(21) Appl. No.: 14/574,055

(22) Filed: Dec. 17, 2014

(65) Prior Publication Data

US 2015/0102028 A1 Apr. 16, 2015

Related U.S. Application Data

(63) Continuation of application No. 14/573,973, filed on Dec. 17, 2014.

(51) Int. Cl.

| | |
|---|---|
| ***A63B 26/00*** | (2006.01) |
| ***A63B 21/00*** | (2006.01) |
| ***B65D 21/02*** | (2006.01) |
| ***B65D 59/04*** | (2006.01) |
| ***B65D 41/04*** | (2006.01) |
| ***A63B 6/00*** | (2006.01) |

(52) U.S. Cl.

CPC ..... *A63B 21/1473* (2013.01); *B65D 21/0228* (2013.01); *B65D 59/04* (2013.01); *B65D 41/04* (2013.01); *A63B 6/00* (2013.01)

(58) Field of Classification Search

CPC ..... A63B 6/00; A63B 21/00047; A63B 21/0005; A63B 21/00054; A63B 21/00105; A63B 21/068; A63B 21/1473; A63B 2023/006; A63B 2208/0252; A63B 2210/00; A47G 19/2205; B65D 1/04; B65D 21/0228; B65D 41/04

See application file for complete search history.

(56) References Cited

U.S. PATENT DOCUMENTS

| | | | | |
|---|---|---|---|---|
| 2,326,414 | A | 8/1943 | Thompson | |
| 2,416,142 | A | 2/1947 | Bennett | |
| 2,645,375 | A | 7/1953 | Topfer | |
| 4,444,324 | A | 4/1984 | Grenell | |
| 4,738,545 | A * | 4/1988 | Westgor | 383/4 |
| 5,010,610 | A * | 4/1991 | Ackley | 5/691 |
| 5,588,550 | A | 12/1996 | Meyer | |
| 6,116,439 | A | 9/2000 | Yaniv | |
| 6,751,816 | B1 * | 6/2004 | Wechsler | 5/417 |
| 7,657,952 | B2 | 2/2010 | Hutchison | |

(Continued)

FOREIGN PATENT DOCUMENTS

| | | |
|---|---|---|
| EP | 0182752 | 5/1986 |
| GB | 2091693 | 8/1982 |

*Primary Examiner* — Oren Ginsberg

(74) *Attorney, Agent, or Firm* — Puget Patent; Michael Gibbons

(57) ABSTRACT

A core provides a form for rolling an accessory around it. The accessory wrapped around the core may include a mat. The core includes a bottle and a container, utilizing what would otherwise be a void at the center of a rolled up mat for storage. The bottle and container may have twist-off lids which form resealable closures. The bottle and container may also couple with one another via opposing reverse threads at the bottom of each of the bottle and container. The twist-off lids may also include connection points for a carry-strap, the carry-strap including a buckle for adjusting the length of the carry-strap to make it a yoga stretching-strap. The mat includes elastic bands through grommets at an end of the mat. The bands are tensioned to secure the core when it is rolled inside the mat via the bands being wrapped around the rolled-up mat and core.

20 Claims, 19 Drawing Sheets

(56) References Cited

U.S. PATENT DOCUMENTS

| | | | | |
|---|---|---|---|---|
| 2002/0130126 | A1 | 9/2002 | Rosenberg | |
| 2009/0255060 | A1 * | 10/2009 | Biggs | 5/417 |
| 2010/0025351 | A1 | 2/2010 | Fowler | |
| 2010/0032537 | A1 | 2/2010 | Andrews | |
| 2013/0042408 | A1 | 2/2013 | Sun | |
| 2013/0126369 | A1 | 5/2013 | Gamelli | |
| 2014/0069970 | A1 | 3/2014 | Thomas, Jr. | |
| 2014/0251938 | A1 | 9/2014 | Rose et al. | |

* cited by examiner

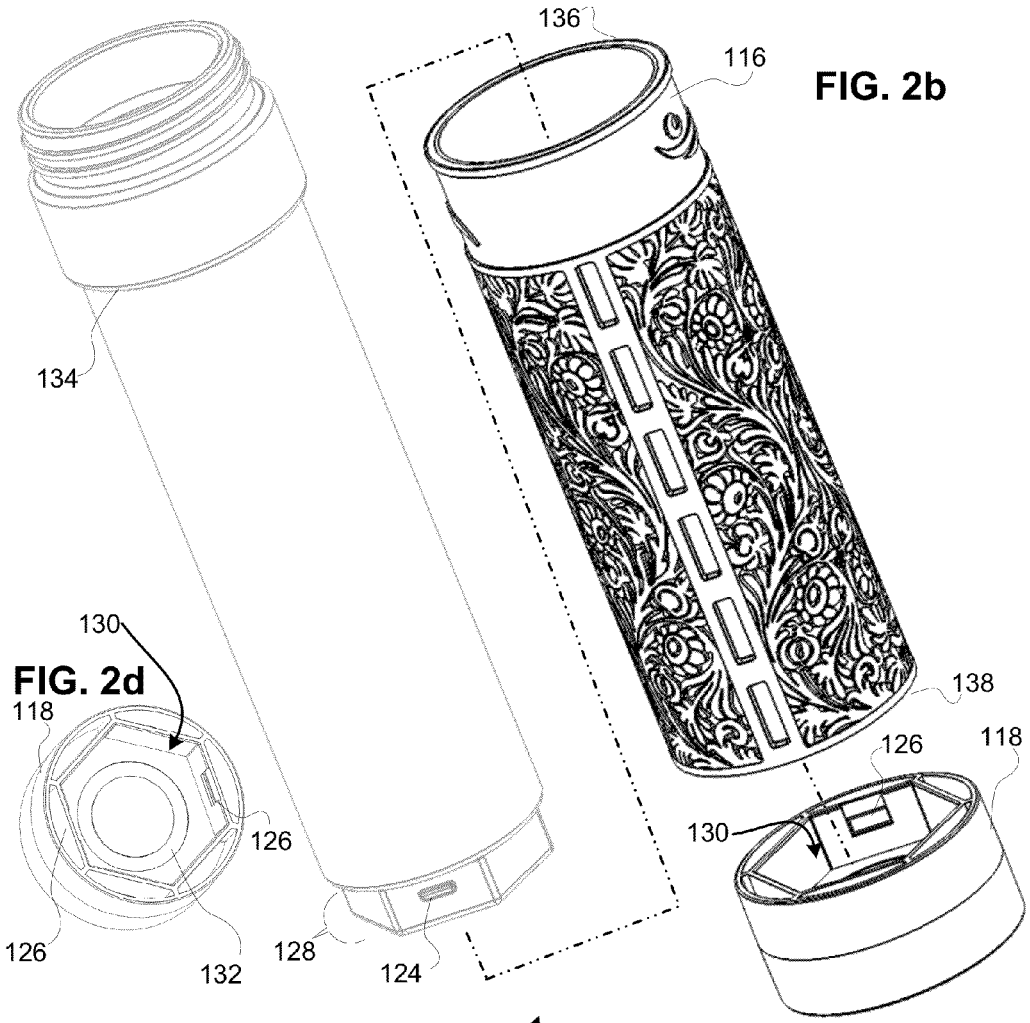
FIG. 2b
FIG. 2d
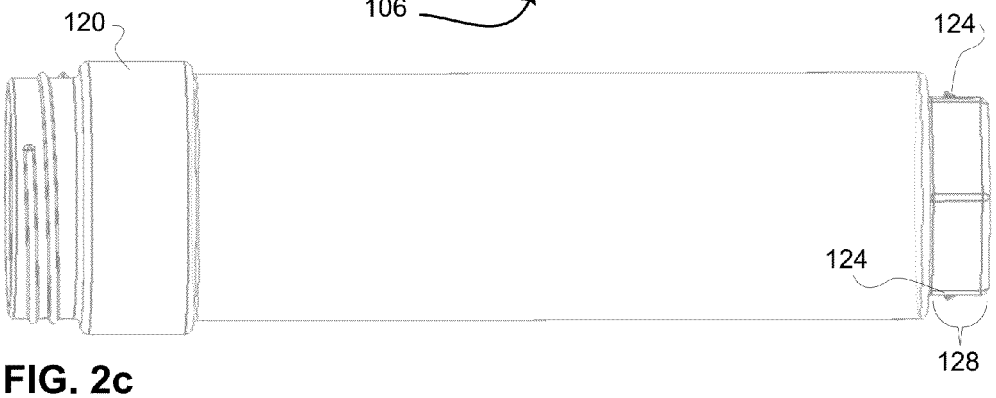
FIG. 2c

CORABLE CONTAINERS AND ACCESSORIES

PRIORITY CLAIM

The present application is related to and/or claims the benefits of the earliest effective priority date and/or the earliest effective filing date of the below-referenced application(s), each of which is hereby incorporated by reference in its entirety, to the extent such subject matter is not inconsistent herewith, as if fully set forth herein:

(1) this application constitutes a continuation of U.S. patent application Ser. No. 14/573,973, entitled CORABLE CONTAINERS AND ACCESSORIES, naming Robert Carrasca, Jasmine Reese, and Jason Woodrow as the inventors, filed Dec. 17, 2014, which is currently co-pending or is an application of which a currently co-pending application is entitled to the benefit of the filing date.

FIELD OF THE INVENTION

This invention relates generally to bottles and jars, and more specifically, to corable containers and accessories.

SUMMARY

In some embodiments, a device comprises a bottle, the bottle including at least a threaded neck; a bottle lid, the bottle lid configured for threadably coupling with the threaded neck of the bottle, the bottle lid including at least a bottle connection point; and a container section, the container section including at least a reverse-threaded portion of the container section configured for cylindrically coupling with at least another portion of the device.

In some embodiments, the container section comprises a container lid; a container, the container including at least a portion of the container configured for threadably receiving the container lid; and a coupling end, the coupling end disposed opposite the at least a portion of the container configured for threadably receiving the container lid, the coupling end including at least the reverse-threaded portion of the container section. In some embodiments, the container lid comprises a container connection point; and a flat face, the flat face enabling the device to rest on a level surface.

In some embodiments, the device further comprises a connector. In some embodiments, the bottle comprises the bottle configured for coupling with the connector, the connector including at least a reverse-threaded portion configured for cylindrically coupling with the container. In some embodiments, the bottle comprises a connector end, the connector end disposed opposite the threaded neck, the connector end including at least an interior reverse-threaded portion configured for cylindrically coupling with the container. In some embodiments, the bottle, the bottle lid, and the container section comprise the bottle and the bottle lid threaded for opening the bottle by turning the bottle lid to the right and closing the bottle by turning the bottle lid to the left; and the bottle and the container section reverse threaded for coupling the bottle and the container section by turning the bottle to the left relative to the container and separating the bottle and the container section by turning the bottle to the right relative to the container.

In some embodiments, the bottle connection point comprises a bottle post, the bottle post mounted within an interior section of the bottle lid. In some embodiments, the container connection point comprises a container post, the container post mounted within an interior section of the container lid. In some embodiments, the bottle lid and the container lid comprise the bottle lid and the container lid wherein threaded portions of the bottle lid and container lid are configured to dispose the bottle post and the container post in a substantially parallel orientation when the bottle lid and the container lid are threaded onto the bottle and container.

In some embodiments, the device further comprises a strap, the strap including at least a first end configured for coupling with the bottle post, the strap including at least a second end configured for coupling with the container post. In some embodiments, the strap comprises the strap which, when coupled with the container post, enables the flat face to rest on a flat surface at least partially via the container post mounted within the interior section of the container lid to accommodate a profile of the coupling of the strap within the interior section. In some embodiments, the strap comprises one or more carabiners, snap-rings, or clips configured for coupling with at least one of the bottle post or the container post.

In some embodiments, the device comprises the bottle, the bottle lid, and the container section including at least a substantially cylindrical profile when coupled, the substantially cylindrical profile enabling one or more items to be wrapped cylindrically around the device. In some embodiments, the device further comprises the bottle connection point and the container connection point remaining exposed upon one or more items being wrapped cylindrically around the device, and a strap, the strap including at least a first end configured for coupling with the bottle connection point, the strap including at least a second end configured for coupling with the container connection point.

In some embodiments, the container comprises the container including at least an interior portion of the container configured for threadably receiving an exterior threaded portion of the container lid. In some embodiments, the bottle comprises a sleeve, the sleeve enclosing at least a portion of a length of the bottle between the threaded neck and a portion of the bottle configured for coupling with the container section. In some embodiments, the sleeve comprises the sleeve including at least a plurality of sights along the at least a portion of the length of the bottle.

In some embodiments, a cylindrical storage system comprises a bottle lid, the bottle lid having a first diameter, the bottle lid including at least an interior threaded portion; a top face, the top face being substantially flat; a bottle lid cutout of at least a portion of the top face and a side portion of the bottle lid; and a bottle post, the bottle post being externally-accessible and transversely mounted entirely within a perimeter of the bottle lid via the bottle lid cutout; a bottle, the bottle having the first diameter, the bottle including at least a mouth at one end of the bottle; a threaded neck disposed adjacent to the mouth, the threaded neck threaded for threadably receiving the interior threaded portion of the bottle lid; a distal end disposed opposite to the mouth; and a sleeve portion disposed adjacent to the distal end, the sleeve portion having a second diameter, the second diameter smaller than the first diameter, wherein the sleeve portion has a length from a top of the distal end to a ridge below the threaded neck; a sleeve, the sleeve having a substantially equal length as the sleeve portion of the bottle, the sleeve including an outer diameter substantially equal to the first diameter and an inner diameter substantially equal to the second diameter, the sleeve including at least a plurality of sights along at least a portion of the length of the sleeve portion, wherein the bottle is inserted into the sleeve exposing at least a portion of the distal end of the bottle; a connector, the connector including at least a portion for removably coupling with the distal end, the connector including at least a reverse-threaded cavity disposed opposite the portion for removably coupling with the distal end of the bottle; a container, the container having the first diameter, the container including at least a reverse-threaded neck; a container opening disposed opposite to the reverse-threaded neck; and an interior threaded portion disposed adjacent to the container opening, wherein the reverse-threaded neck of the container is reverse-threadably receivable by the reverse-threaded cavity of the connector; and a container lid, the container lid having the first diameter, the container lid including at least an exterior threaded portion threaded to be threadably received by the interior threaded portion of the container; a bottom face, the bottom face being substantially flat; a container lid cutout of at least a portion of the bottom face and a side portion of the container lid; and a container post, the container post being externally-accessible and transversely mounted entirely within a perimeter of the container lid via the container lid cutout, wherein the cylindrical storage system has a substantially cylindrical profile upon the bottle lid being threadably coupled with the bottle, the bottle being coupled with the connector, the connector being reverse-threadably coupled with the container, and the container lid being threadably coupled with the container.

In some embodiments, a storage system comprises a bottle, including at least a bottle lid, the bottle lid threadably couplable with the bottle, the bottle lid including at least a bottle connection point; a container, including at least a container lid, the container lid threadably couplable with the container, the container lid including at least a container connection point; and a connector, the connector fixedly coupled with the bottle opposite the bottle lid, the container reverse-threadably couplable with the connector, wherein when the bottle lid, bottle, container, container lid, and connector are coupled, the system has a cylindrical profile including at least a substantially constant outer diameter, substantially flat-faced ends, and a mounting post for receiving a carrying strap disposed within a cutout at each end.

In some embodiments, a system comprises a core, the core including at least a bottle section and a container section, the bottle section and container section couplable to define a cylinder; a mat, the mat including at least one elastic band threaded through at least one grommet of the mat; and a strap, the strap including at least one coupling disposed at each end of the strap, wherein the at least one elastic band is tensioned to securably retain the core inside the mat upon the mat being rolled up around the core, and wherein a first coupling of the strap is couplable with a first end of the core and a second coupling of the strap is couplable with a second end of the core.

In some embodiments, the strap comprises the strap including at least one buckle, the at least one buckle facilitating adjustment of length of the strap. In some embodiments, the system further comprises a towel, wherein the at least one elastic band is tensioned to securably retain the core inside the towel and the mat upon the towel and the mat being rolled up around the core. In some embodiments, the system further comprises a bolster, wherein the at least one elastic band is tensioned to securably retain the core inside the bolster and the mat upon the core being inserted in the bolster and the mat being rolled up around the bolster. In some embodiments, the system further comprises a towel; and a bolster, wherein the at least one elastic band is tensioned to securably retain the core inside the bolster, the towel and the mat upon the core being inserted in the bolster and the towel and mat being rolled up around the bolster.

In some embodiments, the core comprises the core including at least a length of the cylinder equal to or less than the width of the mat. In some embodiments, the core comprises the bottle section and the container section longitudinally couplable to define a cylinder about a longitudinal axis through a length of the bottle section and container section. In some embodiments, the core comprises the bottle section including at least a bottle and a bottle lid threadably couplable with the bottle, the bottle lid including at least a flat top and a bottle connection point; and the container section including at least a container and a container lid threadably couplable with the container, the container lid including at least a flat top and a container connection point, wherein the flat top of the bottle lid is substantially flush with a rolled first edge of the mat upon the mat being rolled up around the core, and wherein the flat top of the container lid is substantially flush with a rolled second edge of the mat upon the mat being rolled up around the core.

In some embodiments, the system includes a length of the core between the flat top of the bottle lid and the flat top of the container lid that is substantially the same as the width of the mat when the bottle section and container section are coupled. In some embodiments, wherein upon the bottle section and container section being coupled and the mat being rolled up around the core, the first coupling of the strap is coupled with the bottle connection point and the second coupling of the strap is coupled with the container connection point to define an all-in-one yoga system.

In some embodiments, the bottle section comprises a bottle; and a bottle lid, the bottle lid including at least a bottle connection point, wherein the first coupling of the strap is couplable with the first end of the core at the bottle connection point. In some embodiments, the strap comprises the strap including at least one coupling removably disposed at each end of the strap. In some embodiments, the core comprises the core including at least a bottle section and a container section, the bottle section and container section reverse-threadably couplable to define the cylinder. In some embodiments, the core comprises the bottle section including at least a bottle and a bottle lid threadably couplable with the bottle; and the container section including at least a container and a container lid threadably couplable with the container.

In some embodiments, the bottle is openable via the bottle lid being turned counter-clockwise relative to the bottle when viewed from above the bottle lid, the container is openable via the container lid being turned counter-clockwise relative to the container when view from above the container lid, and the bottle section and container section are separable via the bottle section and container section being turned clockwise relative to one another.

In some embodiments, the mat comprises a mat including a gripping surface, the gripping surface providing frictional bias to the core upon the mat being rolled up around the core. In some embodiments, the bottle section comprises a bottle, the bottle made substantially of glass (although it may also be plastic or metal); a bottle lid threadably couplable with the bottle; and a connector coupled with the bottle, the connector coupled at an end of the bottle opposite from the bottle lid, the connector made of a non-glass material, the connector facilitating absorption of shock to the bottle section resulting from the bottle section impacting a hard surface.

In some embodiments, the core comprises the bottle section and the container section having a substantially constant diameter along a length of the core.

In some embodiments, an all-in-one yoga system comprises a core, the core having a substantially constant diameter along a length of the core, the core including at least a bottle; a bottle lid, the bottle lid threadably couplable with the bottle, the bottle lid including at least a flat top and a bottle connection point; a container; a container lid, the container lid threadably couplable with the container, the container lid including at least a flat top and a container connection point; a connector; the connector fixedly coupled with an end of the bottle opposite the bottle lid, the connector configured for reverse-threadably receiving the container at an end of the container opposite the container lid; a mat, the mat having a width substantially equal to the length of the core, the mat including at least one or more grommets disposed at one end of the mat; and one or more continuous elastic bands threaded through the one or more grommets, the one or more elastic bands tensioned to securably retain the core inside the mat upon the mat being rolled up around the core and the one or more elastic bands being wrapped around the rolled up mat; and a strap, the strap including at least one or more couplings disposed at each end of the strap; and at least one buckle, the at least one buckle facilitating adjustment of the length of the strap, wherein, when the bottle lid is threadably coupled with the bottle, the container lid is threadably coupled with the container, the container section is reverse-threadably received by the bottle section, the mat is rolled up around the core, and the one or more elastic bands are wrapped around the rolled up mat, at least one coupling of the strap is couplable with the bottle connection point and at least one other coupling of the strap is couplable with the container connection point.

In some embodiments, an all-in-one yoga system, comprises a core including at least a removably couplable bottle and a container; a mat including at least a fastener, wherein the fastener is sized for securably retaining the core within the mat upon the mat being rolled around the core; and an adjustable-length strap, the adjustable-length strap being couplable with a first end of the core and a second end of the core.

In addition to the foregoing, various other methods, systems and/or program product embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings:

FIG. 2*b* is an exploded view of the bottle portion of the bottle section, in accordance with an embodiment of the invention.

FIG. 2*c* is a side view of a receptacle portion of the bottle, in accordance with an embodiment of the invention.

FIG. 2*d* is a top isometric view of a connector portion of the bottle, in accordance with an embodiment of the invention.

DETAILED DESCRIPTION

This invention relates generally to bottles and jars, and more specifically, to corable containers and accessories. Specific details of certain embodiments of the invention are set forth in the following description and in FIGS. 1-10*c* to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1A:
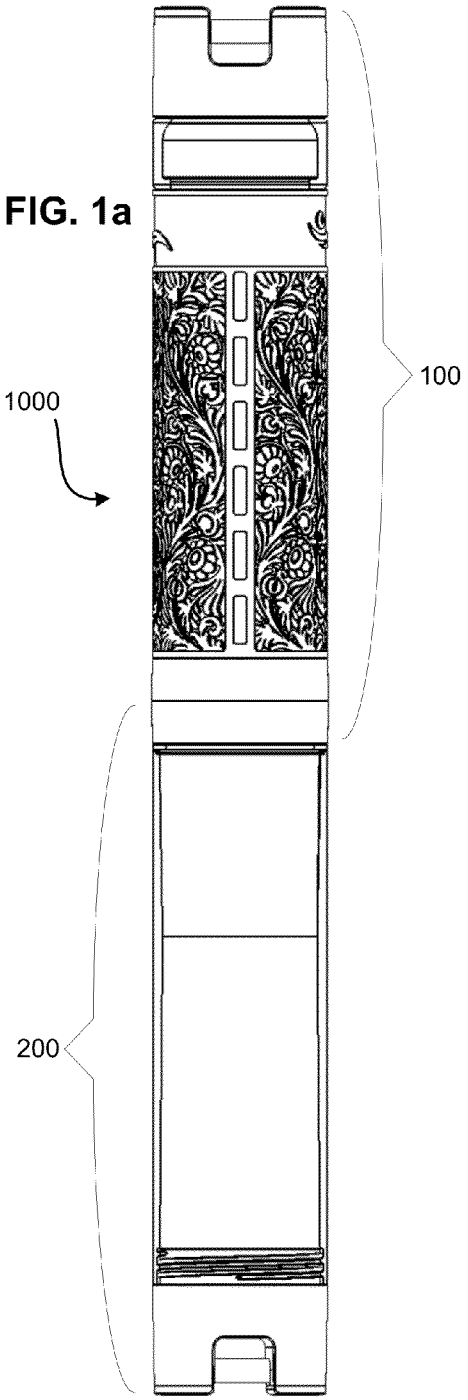
FIGS. 1*a*, 1*b*, 1*c*, and 1*d* are a front view, a first isometric view, a second isometric view, and an exploded view of a core, in accordance with an embodiment of the invention.
Figure 1B:
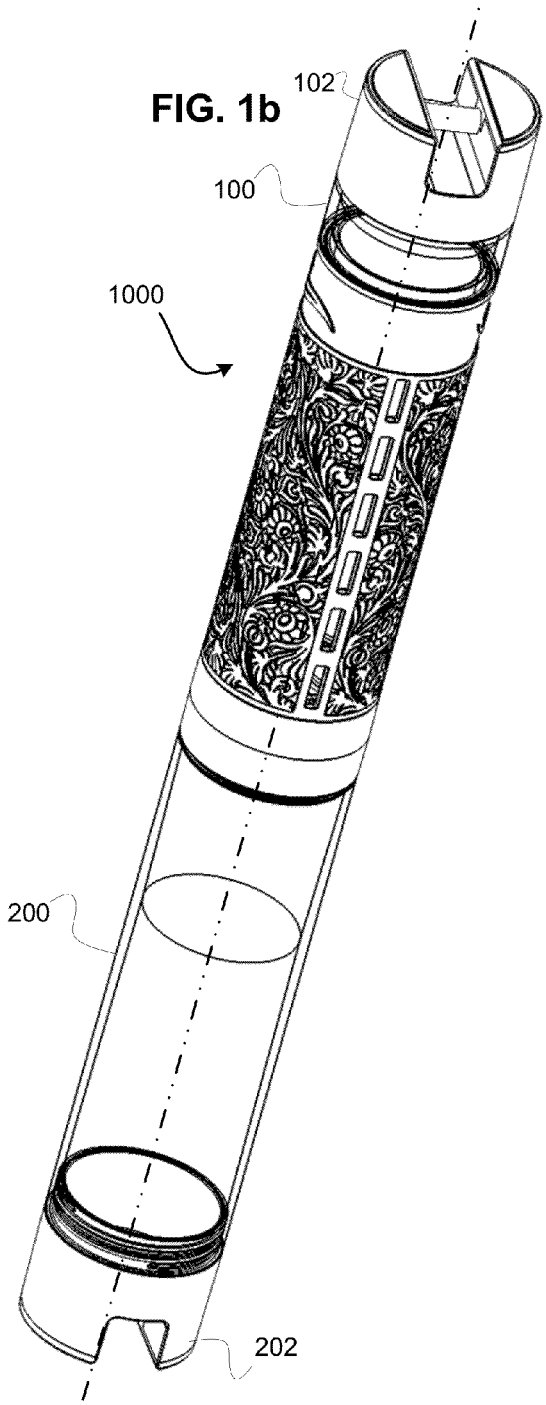

FIGS. 1*a*, 1*b*, 1*c*, and 1*d* are a front view, a first isometric view, a second isometric view, and an exploded view of a core, in accordance with an embodiment of the invention. A core 1000 may consist of several couplable elements and have a substantially cylindrical profile when the elements are coupled. The coupled elements form a cylinder about a longitudinal axis through the center of the elements of the core. For ease of understanding, an imaginary longitudinal center axis is depicted in FIG. 1*b* as the dash-dot-dot line drawn through the center of the core from the bottle end 102 to the container end 202.

Figure 1C:
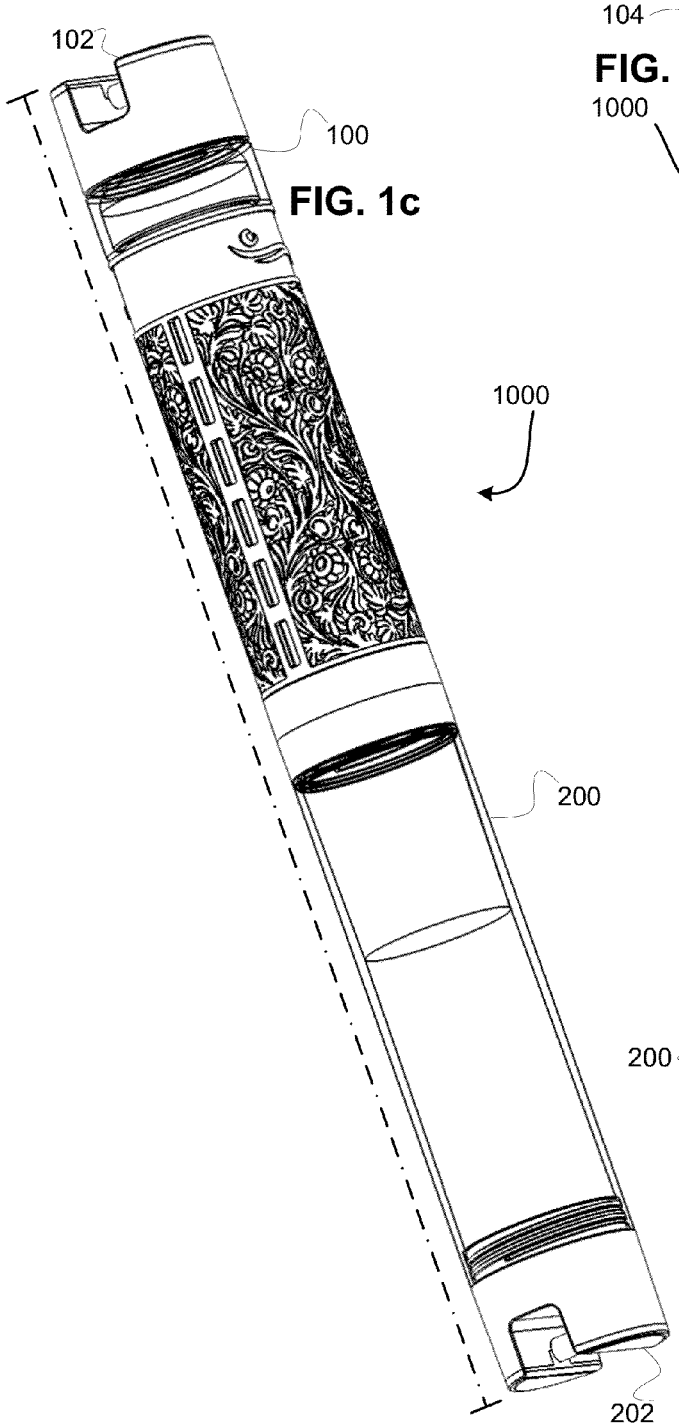
Figure 1D:
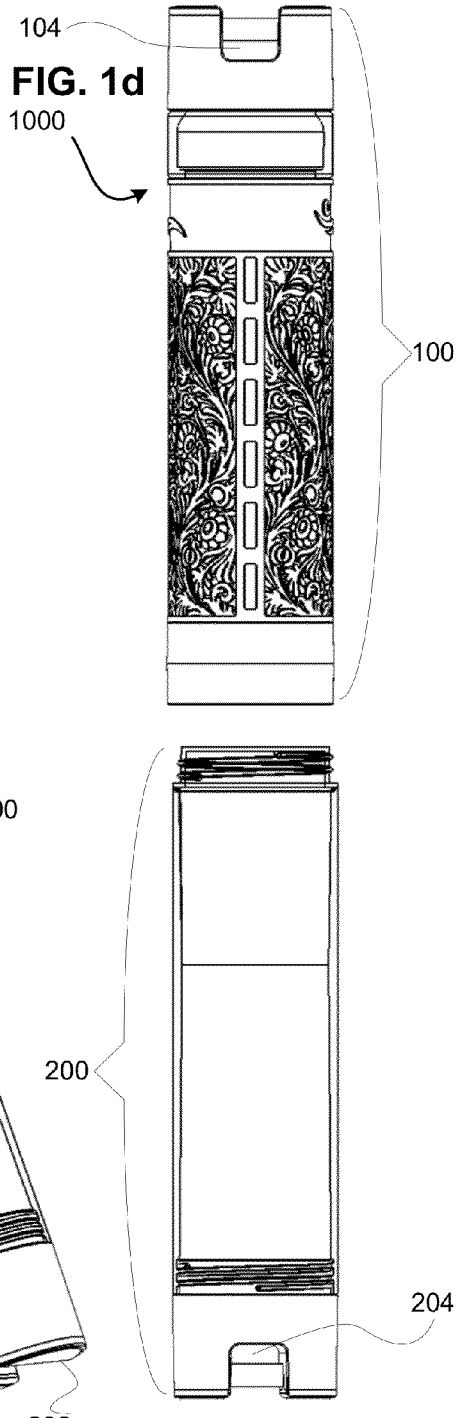

As may best be seen in the exploded view provided by FIG. 1*d*, the core may be comprised of corable containers, such as the bottle section 100 and the container section 200. (FIG. 1*d* also depicts a bottle lid cutout 104 and a container lid cutout 204, which will be discussed further in relation to FIGS. 1*e* and 1*f*.) When the separated bottle section and container section are coupled, they form the core. Hence, the containers (the bottle section and container section) are "corable" because they may form the core when coupled. Joining the sections may be known as "cylindrically coupling" the sections since the two sections, when coupled, define the substantially cylindrical profile of the core.

The core may have a substantially constant diameter along the length of the core, from the bottle end to the container end, the length of the core being depicted in FIG. 1*c* as the dash-dash-dot line between the bottle end and container end. Extending through the longitudinal center axis, diameter lines at most points along the length of the core will have a substantially constant value, providing the substantially cylindrical profile from end to end. The core may also have substantially flat ends (the bottle end and the container end).

The core will most likely not have a perfectly cylindrical shape, only a substantially cylindrical shape. For example, a small gap may exist between the bottle section and the container section when the sections are coupled. If a diameter is measured at the small gap, such diameter would vary from diameters measured at most other points of the cylinder. There may be some slight fluting or flaring near the ends of the cylinder, gaps between other components of the core, or cutout designs and sights in the bottle section, all of which will be discussed below. If diameters are measured at any of these points, the diameter would be less than the substantially constant diameter. In addition, the ends may not be perfectly flat as they may have cutouts for connection points, which will also be discussed in further detail below, but the ends are substantially flat such that the cylindrical core may be placed on a surface standing on its end.

The substantially constant diameter enables accessories to be more easily rolled in a cylinder when wrapping the accessories around the core. For example, consider a yoga mat. After a yoga session, the mat is ordinarily rolled into a cylinder. The rolled-up mat may be placed in a bag for transport. If the mat is not rolled tightly enough, it may not fit into the bag. To correct this, one may begin rolling the mat by rolling one end into a very tight cylinder, but given the pliable and cushioned nature of the yoga mat, the mat may resist being curled so tightly. In an embodiment of the instant invention, one may place the core at one end of the yoga mat and use the core to easily roll the mat into a uniformly-sized cylinder every time the mat is rolled up. No guessing as to how tightly to roll the mat is required.

In addition, when attending a yoga session, an attendee usually carries personal items in addition to a yoga mat to the yoga studio. These personal items could include car keys, a smartphone, a water bottle, etc. Utilizing the vacant center interior of the rolled-up yoga mat for storage reduces the number of items which must be separately carried. The substantially flat ends of the cylinder maximizes the amount of storage space available in the core, without the ends of the core sticking out past the end of the rolled-up yoga mat (provided the mat has a width greater than or equal to the length of the core).

Other applications of the core may be found in camping, for example, where a bed roll is rolled in a manner similar to a yoga mat. However, wrapping an accessory around the core is not required for the core in and of itself to be useful. The core provides storage for multiple items—liquids in the bottle and solids such as keys or smartphones in the container—in a convenient form factor that may be strapped to the owner's back, for example. The core may alternatively be placed upright in a narrow space of a vehicle or in a retail store display. It may be leaned in a corner, or even placed on its end on the floor in an upright orientation. When placed on its end on the floor, the length of the core would enable a taller person to grasp the core to pick it up without having to bend over (or bend over less), for example.

In some embodiments, portions of the bottle section or the container section may be made of a transparent material such as glass or an at least partially-transparent plastic. Accordingly, in certain drawings, it should be understood that some features physically located on the back side of a depicted manufactured element may be visible in the drawing even though they are on the back, because of the transparency or partial transparency of the manufactured element. See, for example, the container end 202 of FIGS. 1*a* and 1*b*, which in this exemplary embodiment includes a container constructed of at least partially-transparent plastic. Threads of the container are shown on the front side of the core near the container end, with a portion of those threads being visible on the back side of the core. (See also FIG. 1*c* near the bottle end 102, where both front and rear threads are visible as this exemplary embodiment includes a clear glass bottle.)

Figure 1E:
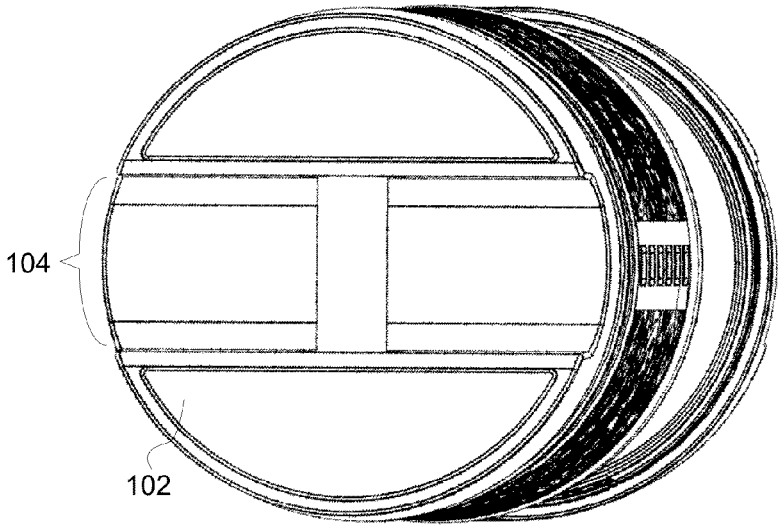
FIGS. 1*e* and 1*f* are a top view of the core, and a bottom view of the core, in accordance with an embodiment of the invention.
Figure 1F:
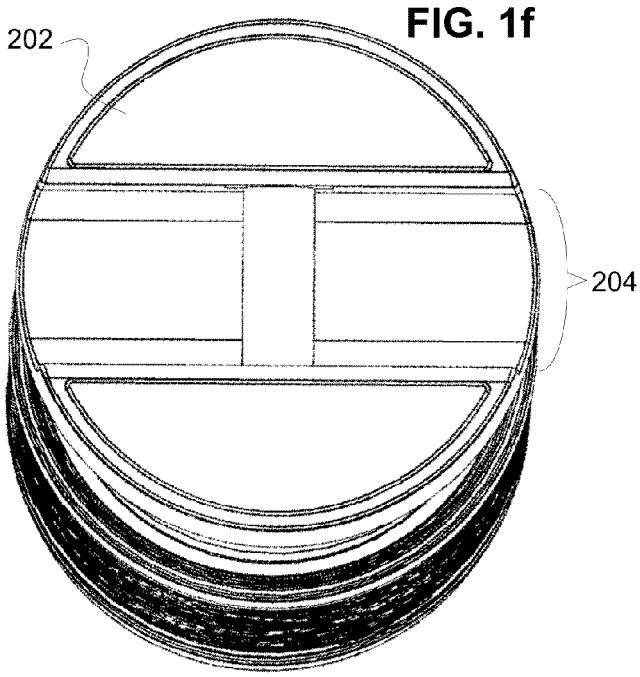

FIGS. 1*e* and 1*f* are a top view of the core, and a bottom view of the core, in accordance with an embodiment of the invention. The bottle end 102 of the core has a substantially flat face on the top of the core. The container end 202 of the core has a substantially flat face on the bottom of the core. A bottle lid cutout 104 and a container lid cutout 204 are shown. As may be seen viewing FIGS. 1*a* through 1*f*, the ends of the cylindrical core are substantially flat, save for the aforementioned cutouts from the ends of the cylinder, the purpose of which will be discussed below. As mentioned previously, the substantially flat faces of the ends permit the core to rest on end, as well as maximize capacity available in the core if used as a storage space inside of a rolled-up mat.

FIGS. 1*g*, 1*h*, 1*i*, 1*j*, and 1*k* are front views of alternate embodiments of the core. In some embodiments, the core may have a sculpted, fluted, or beveled profile in which the cylindrical shape of the core is not substantially uniform as in the embodiment depicted in FIGS. 1*a* through 1*f*. What all the embodiments share, however, is the ability for the core to serve as a means to wrap an accessory, such as a towel or mat, around it. While the alternate embodiments depicted in FIGS. 1 *g* through 1*k* may not have the substantially constant diameter of the core depicted in FIGS. 1*a*-1*f*, the maximum diameter of the core in the alternate embodiments is constant in at least two places: near the top of the core, and near the bottom of the core. The maximum diameter may also be present near the middle of the core. It will be seen that, while the substantially constant diameter of the embodiment of FIGS. 1*a*-1*f* best serves the ability to wrap an accessory around the core, the other embodiments in FIGS. 1*g* through 1*k* would also serve the purpose.

The embodiments discussed thus far have circular cross-sections. However, the core could alternately be rendered with a core having cross-sections other than circular. The core could have, for example, square cross-sections resulting in a core having four sides along the longitudinal axis between the two flat ends. Cross-sections could alternatively be oval, triangular, hexagonal, octagonal, etc., and it is expected that different sections and/or subsections of the core might have differently-shaped cross-sections (e.g. an oval bottle section and a hexagonal container section, or a part-oval part-circular bottle section). Such varying cross-sections could be provided for aesthetic reasons, but the functionality would be similar in that one could still wrap a towel or mat around a differently-shaped core provided that a maximum diameter was constant in at least two, or even three, places.

Figure 2A:
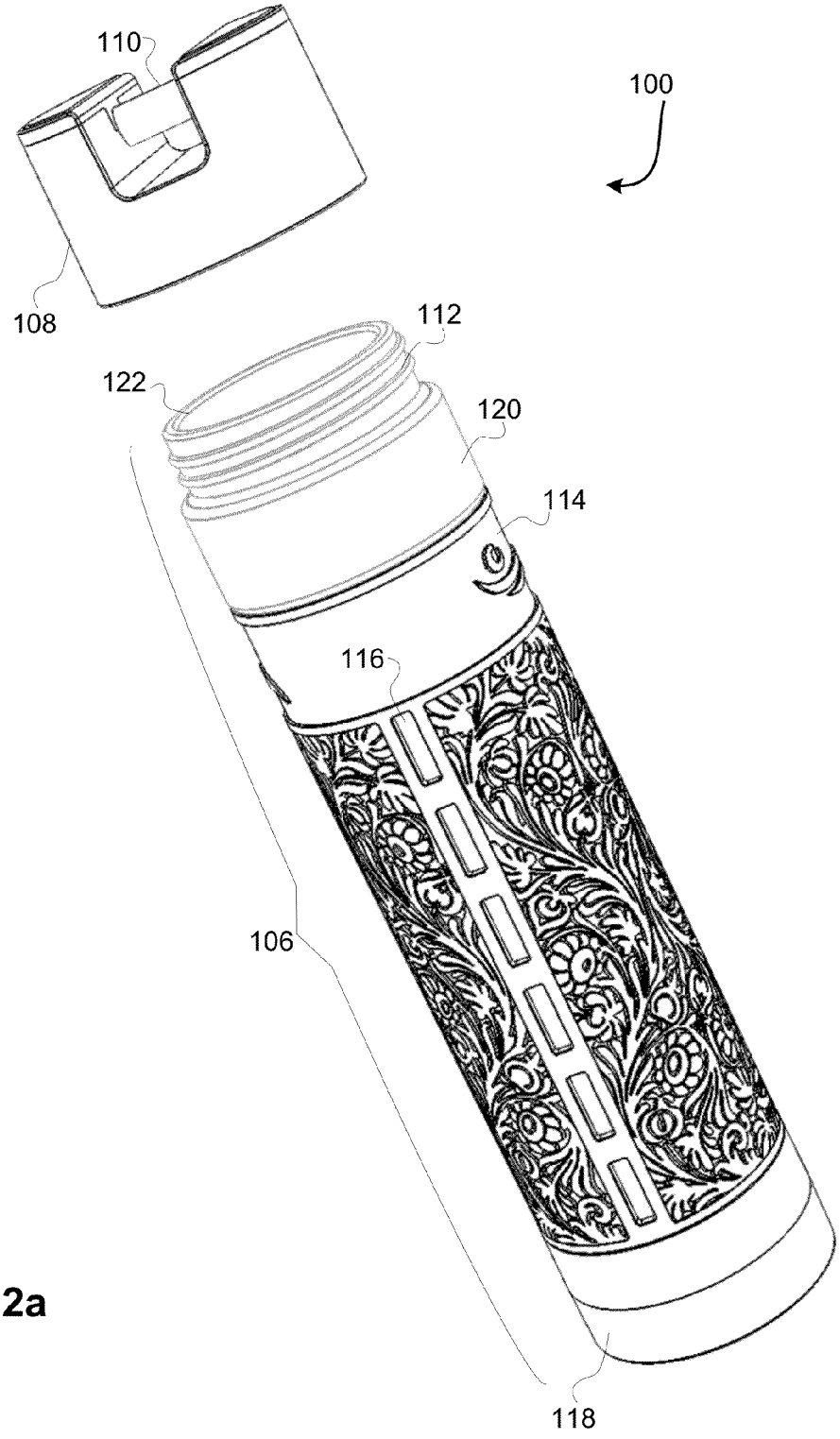
FIG. 2*a* is an exploded view of the bottle section of the core, in accordance with an embodiment of the invention.

FIG. 2*a* is an exploded view of the bottle section of the core, in accordance with an embodiment of the invention. FIG. 2*b* is an exploded view of the bottle portion of the bottle section, in accordance with an embodiment of the invention. FIG. 2*c* is a side view of a receptacle portion of the bottle, in accordance with an embodiment of the invention. FIG. 2*d* is a top isometric view of a connector portion of the bottle, in accordance with an embodiment of the invention. As may be best seen in FIG. 2*a*, the bottle section 100 may include a bottle 106 and a bottle lid 108. The bottle includes a receptacle 120 which may be filled with liquid content such as water, or may be filled with other content. The content passes into and out of the bottle through mouth 122. A threaded neck 112 is disposed along the side of the bottle adjacent to the mouth. The threaded neck includes threads on the exterior of the receptacle, the threads being configured for threadably receiving the bottle lid 108 (threadably receiving meaning the lid may be placed over the bottle neck and twisted to close the bottle lid onto the bottle via the external threads of the bottle engaging their counterpart threads of the interior of the bottle lid).

It should be noted that, unlike in FIGS. 1*a* through 1*c*, only the front threads of the receptacle's threaded neck are visible in FIGS. 2*a*-2*c* as the rear threads have been removed for additional clarity of illustration. However, in the exemplary embodiment of an at least partially clear glass bottle or an at least partially transparent plastic container, some rear threads would be visible through the glass or plastic as may be viewed in FIGS. 1*b* and 1*c*.

In some embodiments, the bottle 106 may include a sleeve 114. The sleeve may be manufactured of a different material than the receptacle 120. For example, in some embodiments, the receptacle may be made of glass. The sleeve, however, may be manufactured of a rubber or silicone type of material. Such material may provide a better grip when the bottle is held by hand and/or may provide better impact-resistance during a fall than the glass would by itself. In some embodiments, the sleeve may have a decorative visual appearance, such as the floral pattern shown in the figures. The visual appearance may be carved into the sleeve (as depicted in the figures) or may be overprinted on the sleeve. In some embodiments, the sleeve, which may not be transparent, may have a one or more sights 116 along one or more sides of the bottle. The sights may permit a user of the bottle to determine how full the bottle is by looking through the sights to see the level of liquid in the receptacle portion. The sights may be cut out of the rubber or silicone sleeve all the way through a circular wall of the sleeve. In some embodiments, the receptacle may be made of plastic, metal, or another material.

In some embodiments, the bottle may also include a connector 118. The connector may be disposed at an end of the bottle opposite the mouth of the bottle. The connector may facilitate coupling of the bottle section with the container section, as will be discussed in further detail below. The connector, which may be constructed of a non-glass material, may also act as a shock absorber should the bottle be dropped.

The parts of the bottle section (receptacle, sleeve, and connector) are assembled as depicted in FIG. 2*b*, with a distal end 128 of the receptacle (the receptacle end opposite the mouth) being inserted into a top portion of the sleeve. The receptacle is passed all the way through the sleeve such that the distal end of the receptacle extends past the bottom edge 138 of the sleeve, and such that the top edge 136 of the sleeve rests against a ridge 134 of the receptacle.

The connector may then be snapped onto the distal end of the receptacle. The distal end of the receptacle may have a hexagonal construction. The receiving recess 130 of the connector may also have a hexagonal interior portion for receiving the distal end of the receptacle. The hexagon shapes of the distal end and the receiving recess are sized substantially the same in the cross-section (i.e. in a plane perpendicular to the longitudinal axis). The hexagonal distal end may be slightly smaller (a millimeter or less) in order to be able to be slid into the hexagonal receiving recess of the connector—otherwise the hexagonal sections are substantially the same size to facilitate mating. In addition, once the distal end is mated with the connector, the receptacle will not rotate relative to the connector as the hexagon acts as a key keeping the receptacle in place.

The distal end of the receptacle includes two or more tabs 124 (two tabs, in a preferred embodiment) disposed on opposite exterior edges of the hexagonal portion of the distal end. The tabs snap into two or more slots 126 (two slots, in the same preferred embodiment) disposed on corresponding opposite hexagonal walls of the receiving recess 130 of the connector. (The slots may be apertures that are disposed all the way through the walls, or only partly through the walls. A gasket 132 may be disposed on the floor of the receiving recess of the connector. The gasket may, when the distal end of the receptacle is pushed into the receiving recess of the connector, apply pressure against the receptacle. Once the tabs mate with the slots, the connector remains tight against the hexagonal distal end of the receptacle via the expanding tendency of the gasket, pushing the receptacle upward and keeping the top of the tabs against the interior portion of the slots.

As may be seen from the figures, in the preferred embodiment some portions of the receptacle may not have the same substantially constant diameter as the container section, the connector, and/or the lids of the core. The threaded neck 112 of the receptacle, for example, has a smaller diameter, but upon the bottle lid being closed over the threaded neck, the core obtains its substantially constant diameter about the threaded neck. Similarly, the distal end 128 of the receptacle (the portion opposite the threaded neck) has a smaller diameter, but upon the connector receiving the distal portion, the core obtains its substantially constant diameter about the distal end. Likewise, the section for accepting the sleeve (the portion of the receptacle between the distal portion to ridge 134) has a smaller diameter, but upon the receptacle being inserted into the sleeve, the core obtains its substantially constant diameter about this section. The remaining portion(s) of the receptacle (e.g. a portion from the ridge to the threaded neck) have the substantially constant diameter of the core.

Bottle lid 108 also includes bottle connection point 110, which will be discussed in further detail below.

Figures 3A, 3B:
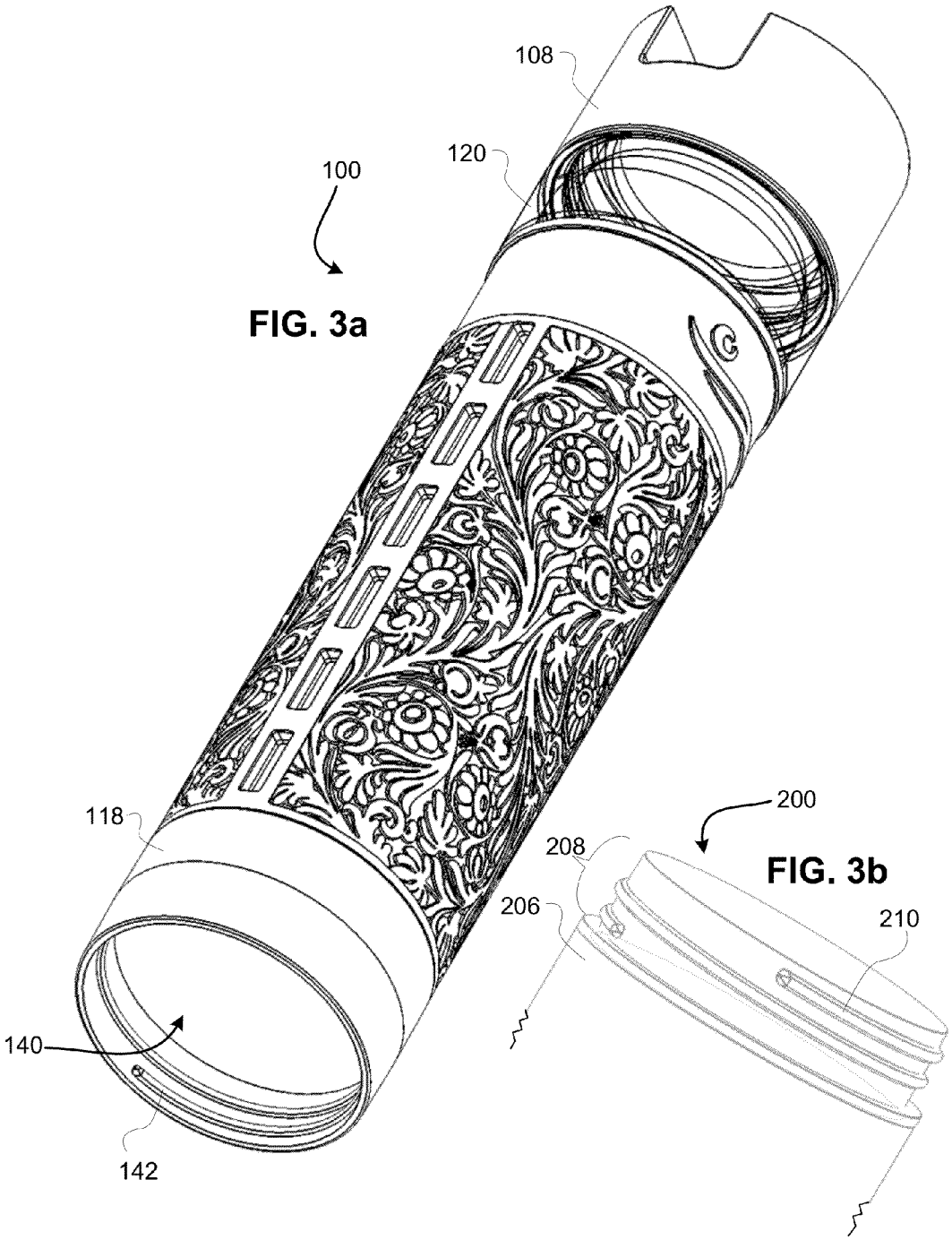
FIG. 3*a* is an isometric view of the bottle section, in accordance with an embodiment of the invention.
FIG. 3*b* is an isometric view of a portion of the container section, in accordance with an embodiment of the invention.

FIG. 3*a* is an isometric view of the bottle section, in accordance with an embodiment of the invention. FIG. 3*b* is an isometric view of a portion of the container section, in accordance with an embodiment of the invention. (FIGS. 3*a* and 3*b* depict the receptable 120 as a clear-glass receptacle such that threads on the rear of the receptacle are visible, including in an interior of the bottle lid 108.) In FIG. 3*a*, the connector 118 is shown in place at the bottom of the bottle section 100, opposite the coupled bottle lid 108. In view is the side of the connector opposite to the receiving recess (the receiving recess having been discussed with respect to FIGS. 2*a* through 2*d*).

The side of the connector opposite to the receiving recess is a reverse-threaded cavity 140, which may be a portion of the bottle section for accepting the container section. Particularly, along an interior wall of the reverse-threaded cavity are one or more reverse threads 142. FIG. 3*b* depicts a reverse threaded portion of the container section 208. The reverse threaded portion may be a coupling end, which is disposed opposite the container end 202 shown in FIG. 1*b*. Particularly, along an exterior circumference of the container are one or more reverse exterior threads 210, which mate with the reverse threads 142 on the wall of the reverse-threaded cavity of the bottle section.

"Reverse threaded" has a particular meaning in the instant disclosure. In a normal threaded coupling (also known as "threaded" without "normal" or "standard"), two parts may be twisted together via what is known as "righty-tightly lefty-loosey" (i.e. clockwise and counterclockwise) to couple or de-couple the two parts, respectively. For example, in some embodiments, the bottle section has a receptacle with an exterior threaded neck, and a bottle lid with threads on the interior walls of the bottle lid. The bottle lid threadably couples with the bottle normally. In other words, to close the bottle lid, one brings the bottle lid into contact with the threaded neck over the mouth of bottle and twists the lid clockwise (to the right when looking down at the bottle from above). To open, one twists the bottle lid counterclockwise (to the left when looking down at the bottle from above).

However, in a "reverse threaded" coupling, the parts couple and separate in the opposite fashion. That is, to couple the two parts, one would twist them counterclockwise and to de-couple them, one would twist them clockwise. "Reverse thread" could also be known as "counter thread" or "cross thread".

Therefore, in a preferred embodiment of the invention, when mating the reverse-threaded container section and the reverse-threaded bottle section, one couples them by twisting them counterclockwise. Separating the reverse-threaded container section and the reverse-threaded bottle section is achieved by twisting them clockwise.

It will be noted that threading the coupling of the bottle section and the container section opposite to the threading of the bottle lid and bottle provides the benefit in the preferred embodiment that one cannot inadvertently separate the bottle and container when intending to open the bottle. Were the bottle section and container section separable by twisting them the same direction as opening the bottle, if the bottle lid was closed very tightly, when twisting it counterclockwise to open the bottle one could rotate the entire bottle section, causing the bottle section to separate from the container section. Providing threading arrangements for the bottle/bottle lid and bottle section/container section in opposite directions is useful to prevent inadvertent separation of the wrong part (for example, inadvertently opening the bottle when intending only to separate it from the container section).

Reverse-threaded does NOT refer, within the instant disclosure, to two opposing parts in the same coupling set having a first threaded piece and a second threaded piece where the second threaded piece is the reverse of the first threaded piece. For example, in a coupling set including a bottle with a threaded neck and a lid with a threaded interior for mating with the threaded neck, the threaded neck is not the reverse of the threaded interior (and vice-versa). These pieces are called "opposing," "mating", or "counterpart" within the instant application, irrespective of whether they are reverse-threaded or not. Reverse-threaded means that a first coupling set in the invention couples and separates differently than a second coupling set in the invention. Reverse-threaded would have no meaning within the instant disclosure if there were not at least two couplings (e.g. the bottle lid and bottle being a first coupling, and the bottle section and container section being a second coupling).

Further, "reverse-threaded," within the instant disclosure, does not refer to whether the parts in a coupling set couple or separate by twisting them clockwise or counter-clockwise. Reverse-threaded merely means that if a first set couples by twisting the pieces clockwise and de-couples by twisting them counter-clockwise, the reverse-threaded second set couples by twisting the pieces counter-clockwise and de-couples by twisting them clockwise. It is not material the particular direction that an individual coupling set twists to operate, except to the extent that it is the other direction when compared to a different coupling set in the invention. In some embodiments, the bottle lid and bottle may be threaded such that coupling the lid is achieved by twisting it clockwise relative to the bottle, and the bottle section and container section are reverse-threaded such that coupling the sections is achieved by twisting them counter-clockwise relative to each other. In different embodiments, the bottle lid and bottle may be threaded such that coupling the lid is achieved by twisting it counter-clockwise relative to the bottle, and the bottle section and container section are reverse-threaded such that coupling the sections is achieved by twisting them clockwise relative to each other. "Reverse-threaded" therefore means only that a coupling set couples and separates by twisting the pieces in different directions when compared to another coupling set in the invention. "Normal-threaded" likewise does not implicate a particular clockwise or counter-clockwise rotation for coupling/de-coupling, and means only that coupling/de-coupling operations are the reverse of those of the "reverse-threaded" coupling.

Figure 1G:
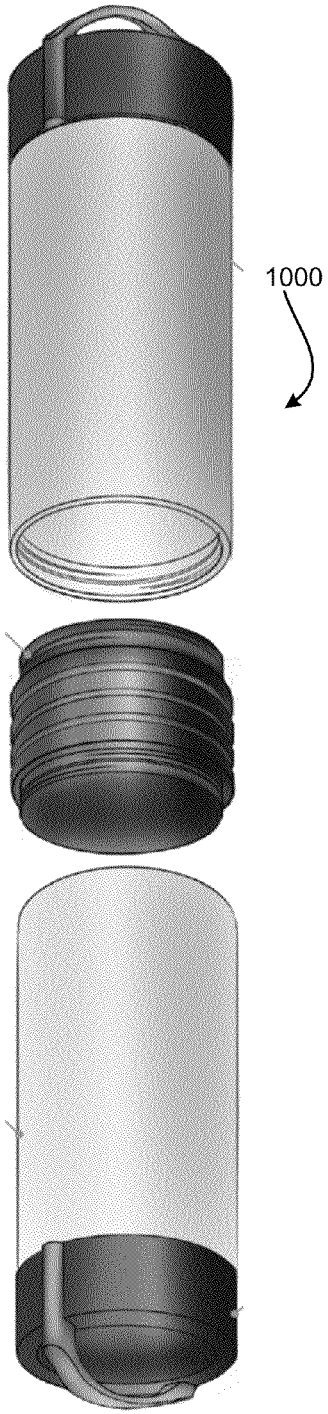
FIGS. 1*g*, 1*h*, 1*i*, 1*j*, and 1*k* are front views of alternate embodiments of the core.

Returning to FIG. 1*g*, an alternate embodiment is depicted in which the bottle section does not include the connector, as it does in the embodiment shown in FIG. 2*a*. In different embodiments such as that depicted in FIG. 1*g*, the connector could be a separate component from either the bottle section or the container section. In addition, as may be seen in FIG. 1*h*, in different embodiments the connector could be a portion of the container section rather than the bottle section. In addition, rather than being fixedly coupled with the bottle section as shown and discussed with respect to FIGS. 2*a* through 2*d* (i.e. the connector having a threaded and/or reverse-threaded portion on only one side of the connector), the connector may, as depicted in FIG. 1*g*, have threaded portions on two sides for receiving opposing threaded portions of both the bottle section and the container section. Alternatively, in some embodiments, no connector is used. In such embodiments the bottle section and container section may have threads molded or otherwise fabricated directly into the bottle or container. Or, the bottle section and container section may couple magnetically, or with a snap-together type of coupling, or with side latches which bring the sections together with a gasket in between the sections opposing the latches.

Figure 4:
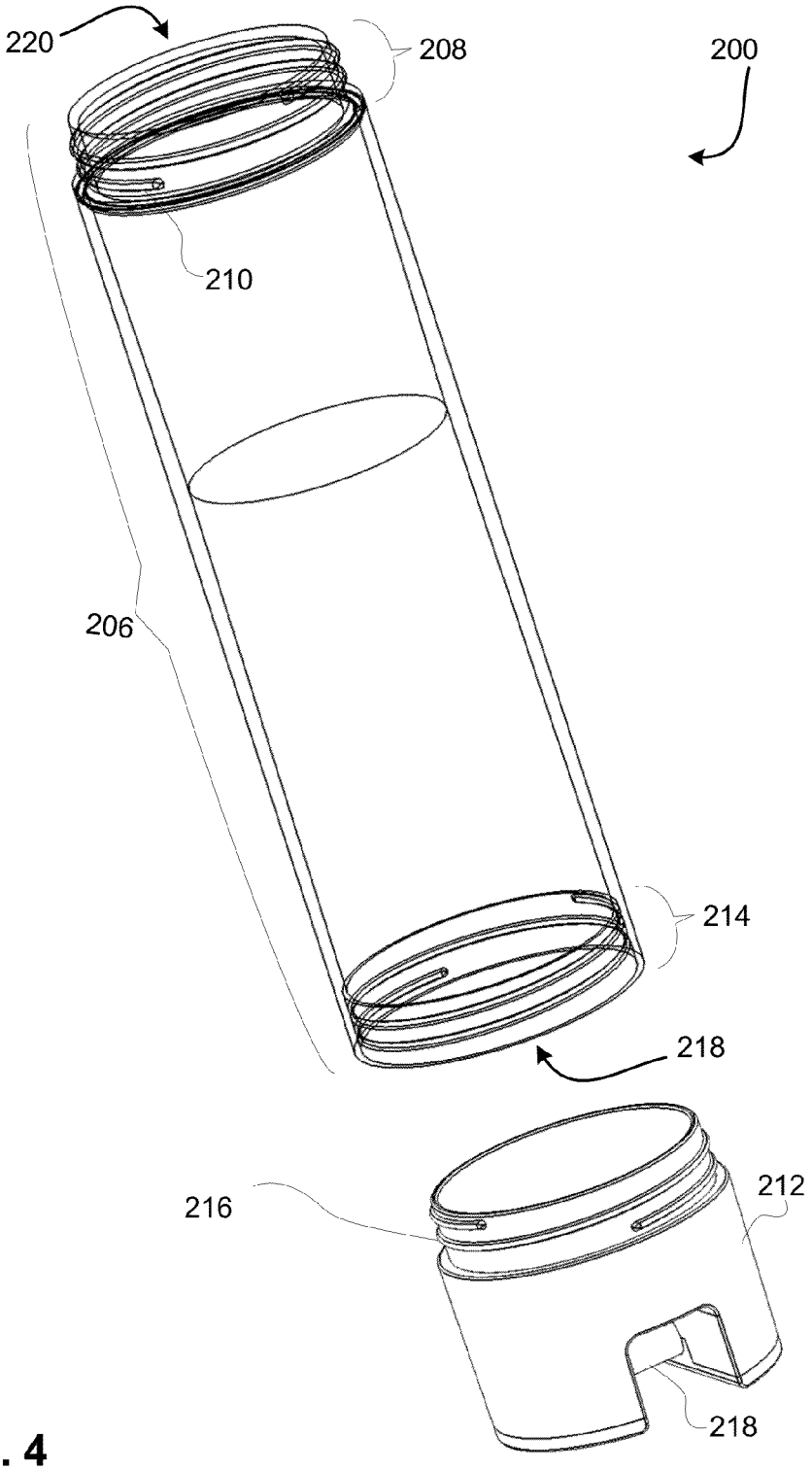
FIG. 4 is an isometric view of the container section, in accordance with an embodiment of the invention.

FIG. 4 is an isometric view of the container section, in accordance with an embodiment of the invention. Container section 200 includes the container 206 and a container lid 212. The container may be constructed of an at least partially transparent material, such as plastic, although other material choices such as glass or metal are possible. Notably, in FIG. 4, due to the transparent nature of the container, the exterior reverse threads 210 of the reverse threaded portion 208 are depicted on both the front and rear sides of the bottle. In addition, both the front and back of the interior threads of the lid receiving portion 214 are visible in FIG. 4. (If the container were made of an opaque or solid material, only the front threads would be visible.)

The container may be sized to hold objects for transport, such as a smartphone, keys, scented wipes or towels, snack bars or other food items, etc. In a preferred embodiment, the container lid threads into the mouth 218 of the container to form a resealable closure. Threading the container lid into the interior of the container is unlike the bottle section, where the bottle lid threads onto the exterior of the receptacle. As may be seen in FIG. 2*a*, the receptacle 120 of the bottle 106 has a threaded neck 112 that is narrower than the outer diameter of the receptacle and sleeve 114 (which may be seen in FIG. 2*a*) so that the bottle lid 108 threads over the exterior of the bottle, while the bottle lid and bottle still maintain a substantially constant outer diameter. In contrast (returning to the container section shown in FIG. 4), a lid receiving portion 214 of the container has threads molded or carved into the interior portion adjacent to the mouth of the container. These threads mate with the opposing threads 216 on the container lid 212, which are inserted into the container to form the threadably-coupled resealable closure.

The distal end 220 of the container, which is the end opposite the container mouth, may be a closed end such that when the container section is separated from the bottle section, items do not fall out of the container through the distal end. (The distal end is not viewable in FIG. 4 because, as explained above, the distal end may be constructed of the at least partially-transparent plastic, in which the rear reverse threads would still be visible.) In different embodiments, the distal end of the container may be at least partially open to allow items to pass into or out of the container from either its mouth or from its distal end. In such embodiments, items would remain secure within the container when the container section was coupled with the bottle section and the container lid was closed.

Container lid 212 also includes container connection point 218, which will be discussed in further detail below.

A benefit to the container lid threading into the container is that items as wide as the inner diameter of the container may be passed into the bottle, even though the container lid and container have a substantially constant outer diameter. If the container lid were configured like the bottle lid (e.g. the container having a threaded neck), then the mouth of the container would necessarily be narrower and wider items (such as a smartphone) would be unable to be passed into the container.

Additionally, the benefit of not inadvertently opening the container when intending to separate the container section and bottle section is also present due to the normal threading of the container lid and reverse threading of the container section's coupling with the bottle section. Conversely, the container section and bottle section can't be inadvertently separated by twisting the container lid with an intent to open the container.

Returning to FIG. 1*h*, in different embodiments, the interior of the container section might be accessible by a door on the side of the container, rather than through a container lid. The door may be a hinged door, with the door being hinged in an axis parallel to the center longitudinal axis of the core. The door may be kept closed by a frictional closure, a magnet, a latch, a snap, a hook-and-loop style tab affixed to the door and the container, or any other suitable means of closure. In some embodiments, the door is held closed when a mat is rolled around the container. In still other embodiments, the container may be divided in two halves that are hingedly coupled longitudinally (i.e. similar to a pneumatic tube seen at bank drive-through windows). In other embodiments, the interior of the container could be accessible by both the door and through the mouth of the container when the container lid is removed.

FIGS. 5*a*, 5*b*, 5*c*, and 5*d* are a front view, a side view, a top view, and a bottom view of a bottle lid, in accordance with an embodiment of the invention. FIGS. 5*e* and 5*f* are a top isometric view and a bottom isometric view of the bottle lid, in accordance with the embodiment of the invention. FIGS. 5*g* and 5*h* are front exploded view and a side exploded view of the bottle lid, in accordance with the embodiment of the invention.

In some embodiments, the bottle lid 108 has a substantially cylindrical profile with an outer diameter substantially constant with the outer diameter of the bottle section. The bottle lid may, in some embodiments, have a beveling from the bottom of the lid to the top (i.e. a larger diameter bottom than top), of no more than 45 degrees but preferably less than 10 degrees. The preferred beveling (or no beveling) would largely maintain the cylindrical profile such that an object may be wrapped around the core when the bottle lid is closed.

In some embodiments, the bottle lid has a bottle lid cutout 104, which provides access to the bottle connection point 110. The bottle lid may have a top face 144, which may be a substantially flat face such that the bottle section, when the bottle lid is closed onto the bottle, could be rested on end upside-down (i.e. with the bottle lid top face contacting the level surface on which the bottle was rested).

Cut away from the bottle lid is a bottle lid cutout 104, which is cut from a portion of the top face and a portion of the cylindrical side of the bottle lid. The bottle lid cutout provides access to the bottle connection point. The bottle connection point may be a post. The post is transversely-mounted, perpendicular to the longitudinal axis of the core.

As may be seen in FIGS. 5*g* and 5*h*, the post may be mounted inside the bottle lid by being sandwiched between a bottle lid base 154 and snap top pieces 152. The base and snap top pieces have arcuate portions for receiving the post. The arcuate portions are disposed next to the exterior walls of the post at its top and bottom. Upon cradling the post into the arcuate portions of the bottle lid base, the snap top is placed on top of the base. Four screws 150 may be threaded through four apertures in the snap top pieces and received by threaded mounting channels 158 in the base. Once the post is mounted into the lid, rubber covers 148 are coupled with the top of the snap top pieces, covering the screw heads, and providing the flat top face 144 of the bottle lid.

Figure 5A:
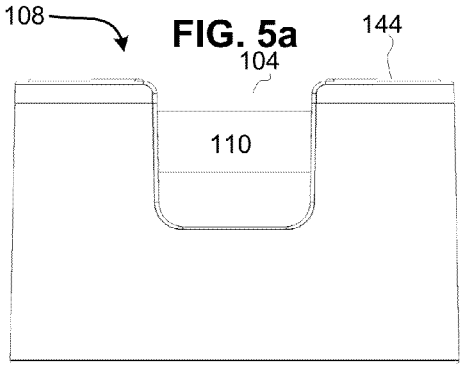
FIGS. 5*a*, 5*b*, 5*c*, and 5*d* are a front view, a side view, a top view, and a bottom view of a bottle lid, in accordance with an embodiment of the invention.
Figure 5B:
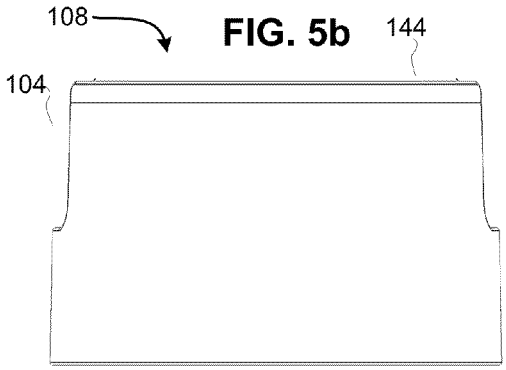
Figure 5C:
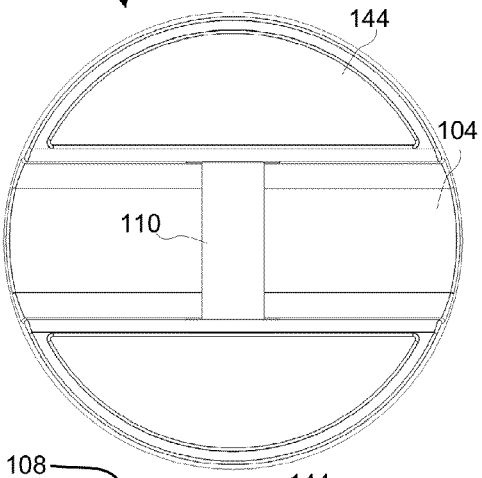
Figure 5D:
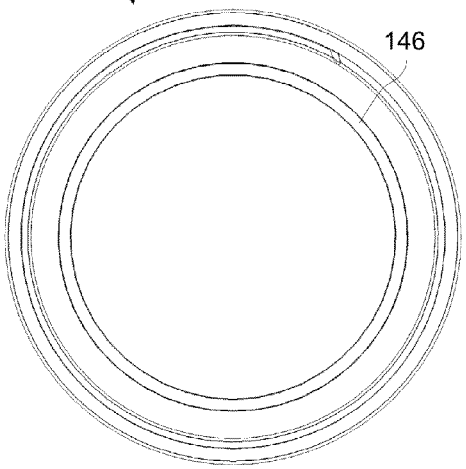
Figure 5E:
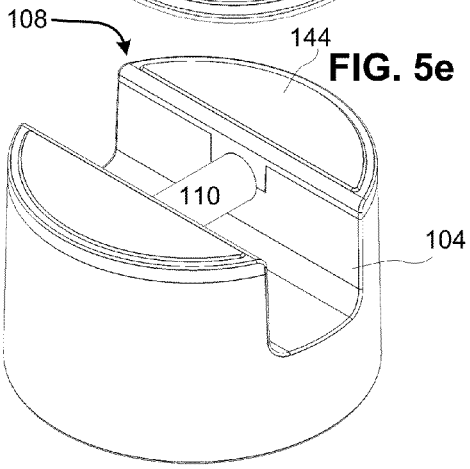
FIGS. 5*e* and 5*f* are a top isometric view and a bottom isometric view of the bottle lid, in accordance with the embodiment of the invention.
Figure 5F:
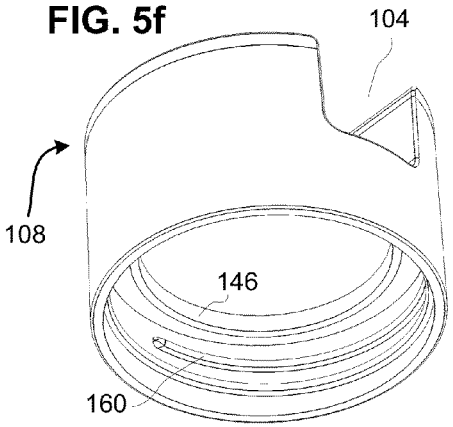
Figure 5G:
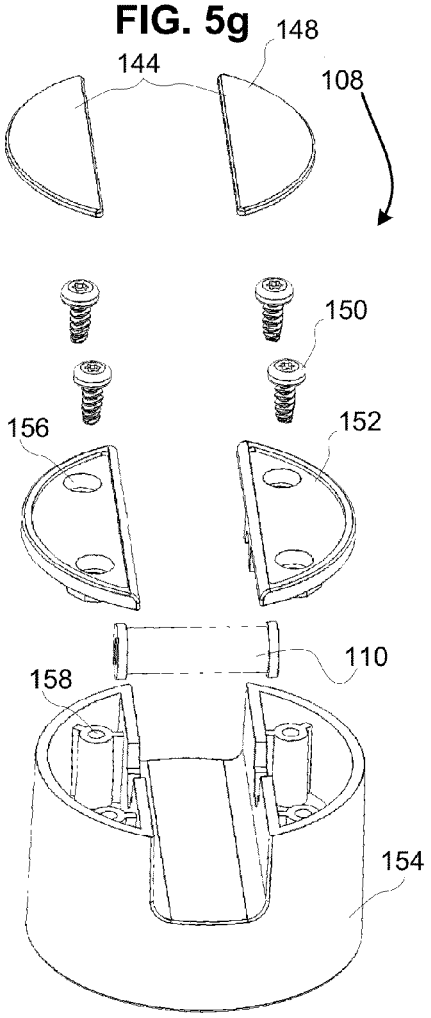
FIGS. 5*g* and 5*h* are front exploded view and a side exploded view of the bottle lid, in accordance with the embodiment of the invention.
Figure 5H:
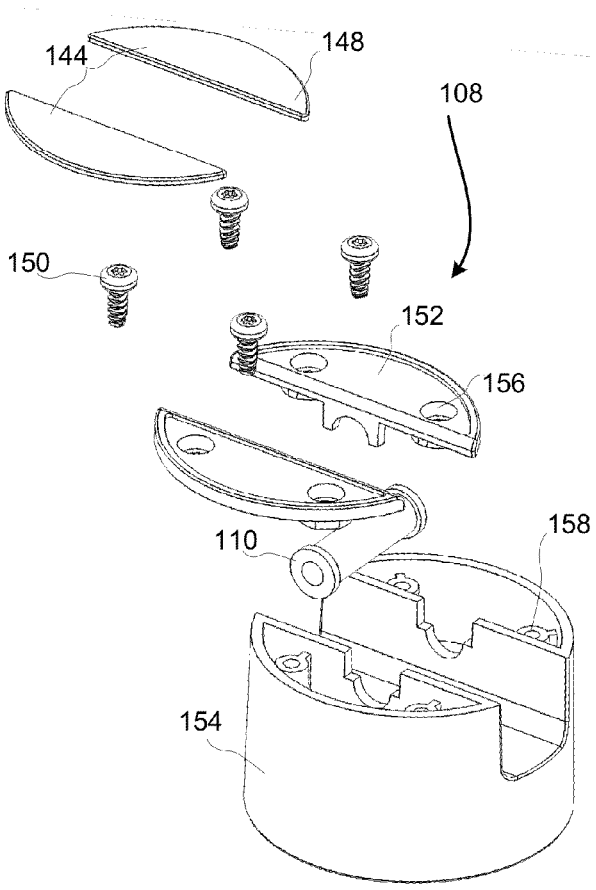

Turning to FIG. 5*d*, a gasket 146 may be present inside the bottle lid. The gasket operates to maintain a tight seal when the resealable closure of the bottle is formed by the bottle lid being closed over the receptable. In FIG. 5*f*, the threads 160 on the interior walls of the bottle lid are visible; these threads mate with the threaded neck 112 of the receptacle shown in FIG. 2*a*.

When the bottle lid is assembled, the resulting mounting location of the post is within an interior region of the bottle cutout, below the top face of the lid. The post is capable of receiving a carabiner or other coupling, which may be disposed at an end of a strap. The coupling could alternatively be a loop, a hook, a clip, a snap-ring, or another type of fastener. When a strap is coupled at the bottle connection point (post), the entirety of the coupling may stay below the top face of the lid. The bottle could, for example, rest upside down even when a strap is coupled to the post, as the coupling and strap would exit the interior of the bottle cutout through the side of the bottle lid.

Figure 1H:
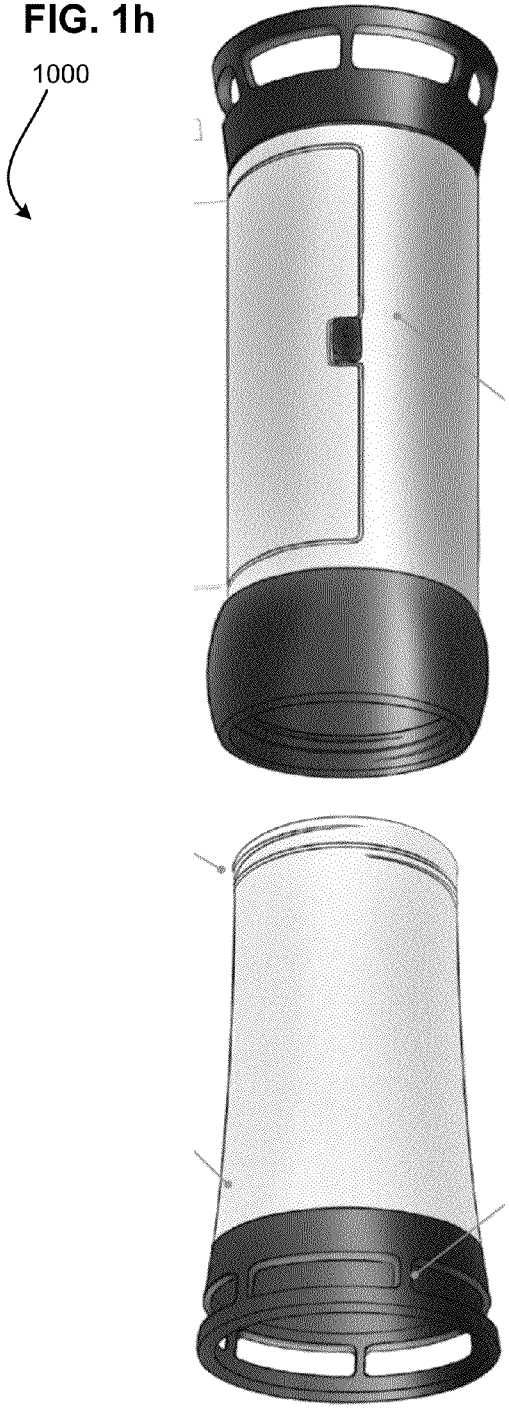
Figure 1I:
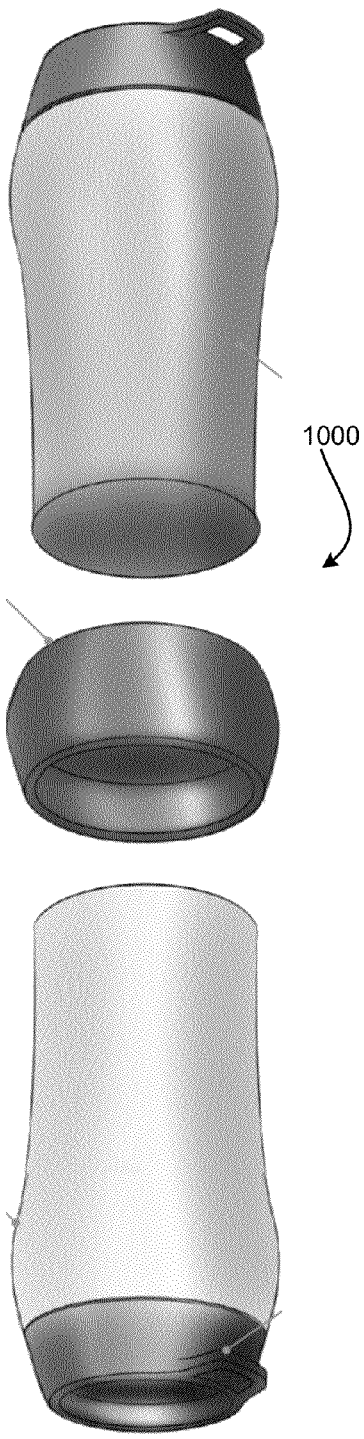
Figure 1J:
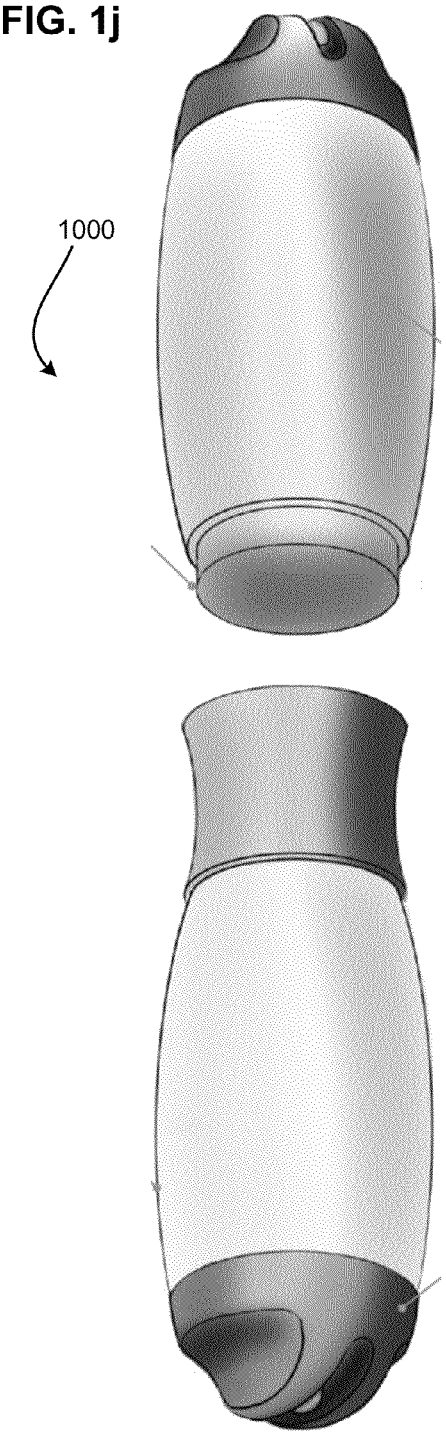
Figure 1K:
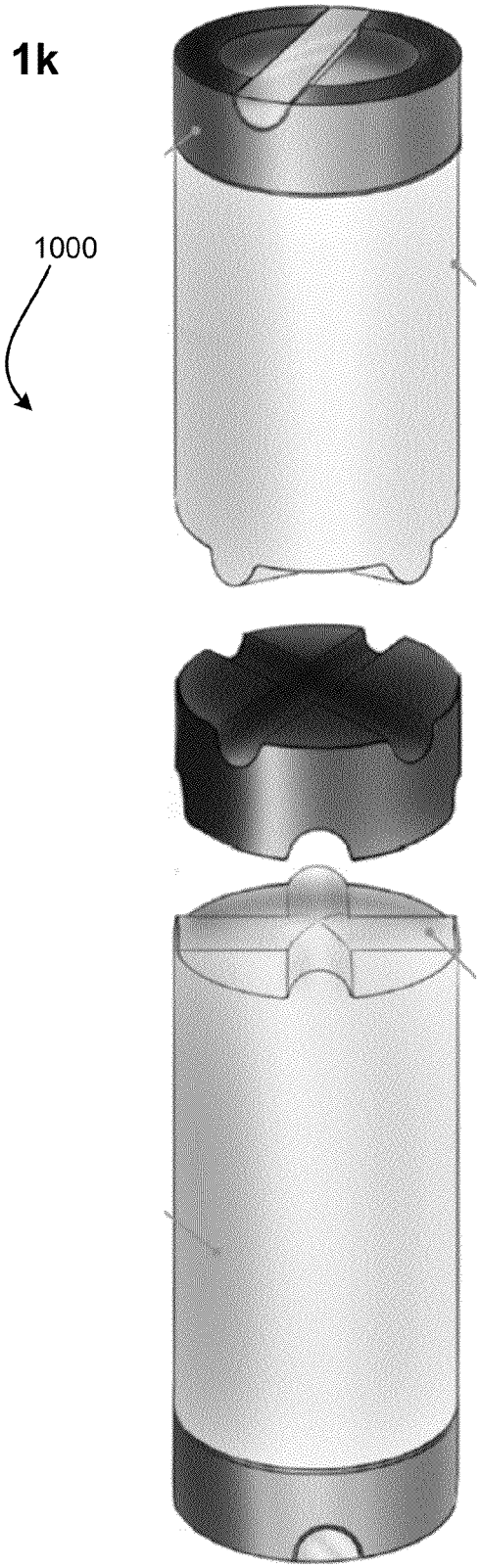

In different embodiments, a bottle connection point may include cutouts from a portion of the lid as seen in FIG. 1*h*. Alternatively, a bottle connection point may include a loop fabricated as a part of, or adhered to, the lid itself, as seen in FIG. 1*g*. In other embodiments, the bottle connection point could be a half-cylindrical post disposed within the face of the lid with a cavity underneath for receiving a hook, as seen in FIG. 1*k*.

FIGS. 6*a*, 6*b*, 6*c*, and 6*d* are a front view, a side view, a top view, and a bottom view of a bottle lid, in accordance with an embodiment of the invention. FIGS. 6*e* and 6*f* are a top isometric view and a bottom isometric view of the bottle lid, in accordance with the embodiment of the invention.

In some embodiments, the container lid 212 has a substantially cylindrical profile with an outer diameter substantially constant with the outer diameter of the container section. The container lid may, in some embodiments, have a beveling from the bottom of the lid to the top (i.e. a larger diameter bottom than top), of no more than 45 degrees but preferably less than 10 degrees. The preferred beveling (or no beveling) would largely maintain the cylindrical profile such that an object may be wrapped around the core when the container lid is closed.

In some embodiments, the container lid has a container lid cutout 204, which provides access to the container connection point 220. The container lid may have a top face 222, which may be a substantially flat face such that the container section, when the container lid is closed onto the bottle, could be rested on end upside-down (i.e. with the container top face contacting the level surface on which the container was rested). The entire core may be rested on end in the foregoing manner.

Cut away from the container lid is a container lid cutout 204, which is cut from a portion of the top face and a portion of the cylindrical side of the container lid. The container lid cutout provides access to the container connection point 220. The container connection point may be a post. The post of the container lid is transversely-mounted, perpendicular to the longitudinal axis of the core. The post of the container lid is mounted inside the container lid by being sandwiched between a base and snap top pieces of the container lid in a manner similar to that described with respect to the bottle lid and the discussion of FIGS. 5*g* and 5*h*.

Figure 6A:
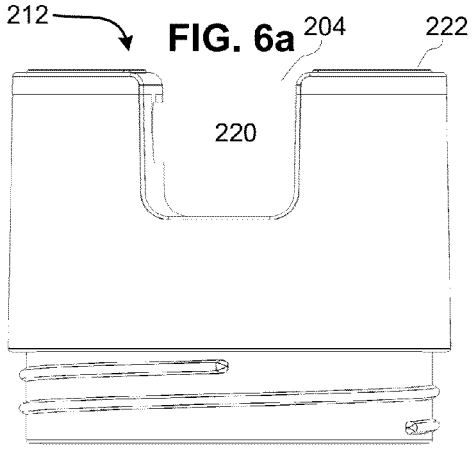
FIGS. 6*a*, 6*b*, 6*c*, and 6*d* are a front view, a side view, a top view, and a bottom view of a bottle lid, in accordance with an embodiment of the invention.
Figure 6B:
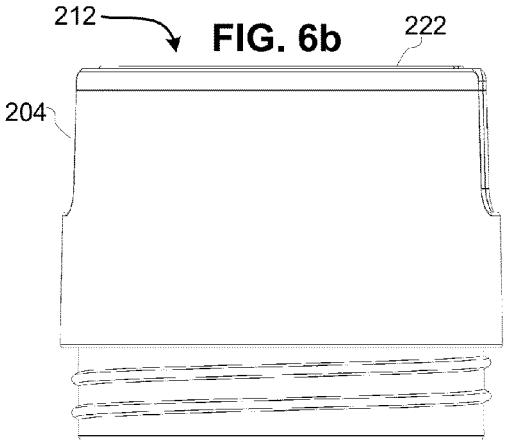
Figure 6C:
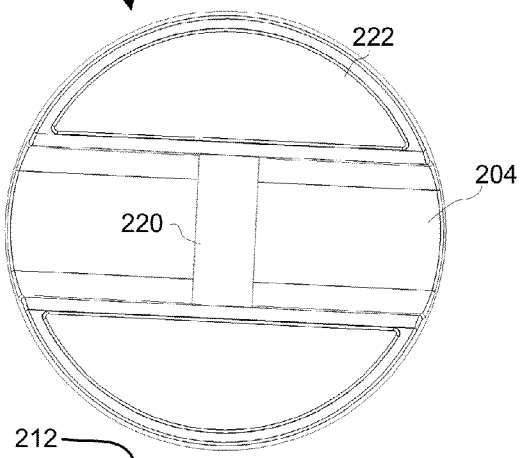
Figure 6D:
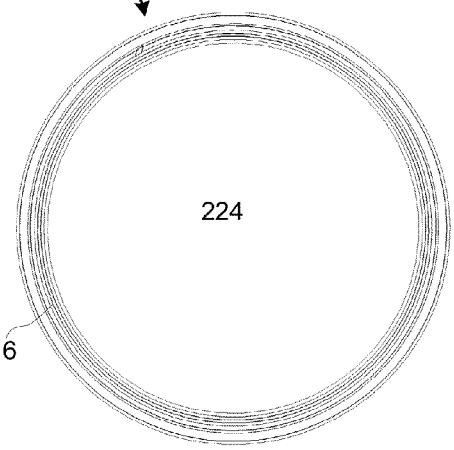
Figure 6E:
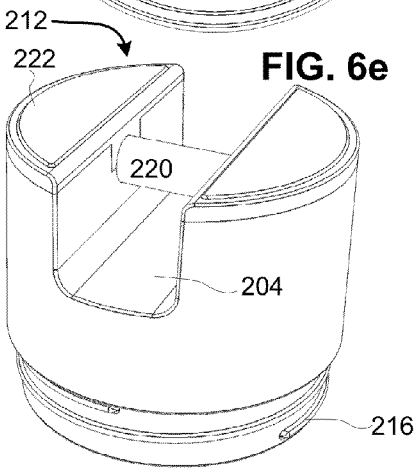
FIGS. 6*e* and 6*f* are a top isometric view and a bottom isometric view of the bottle lid, in accordance with the embodiment of the invention.
Figure 6F:
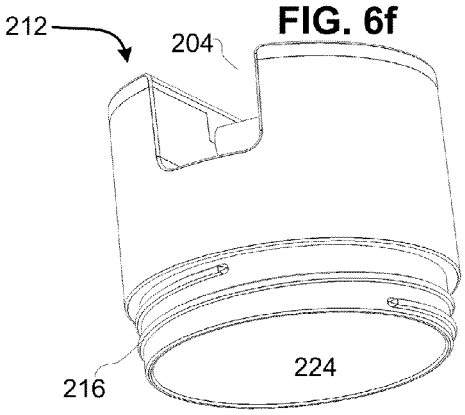

Also in view in FIGS. 6*d* through 6*f* are the external threads 216 of the container lid which mate with the opposing threaded portion 214 on the inside of the container as seen in FIG. 4. An underside 224 of the container lid may be a solid bottom (i.e. a flat surface opposite the top face and positioned adjacent to the bottom of the external threads). In different embodiments, the underside 224 of the container lid may be on the underside of the cutout portion of the base of the container lid, providing a recess on the inside of the container lid.

In some embodiments, the container lid does not have a container connection point and the core is coupled with the strap using only a single connection point (that being the connection point on the bottle lid). In the preferred embodiment, the post is capable of receiving a carabiner or other coupling, which may be disposed at an end of a strap. The coupling could alternatively be a loop, a hook, a clip, a snap-ring, or another type of fastener. When a strap is coupled at the container connection point (post), the entirety of the coupling (e.g. a flat clip) may stay below the top face of the lid. The container could, for example, rest upside down even when a strap is coupled to the post, as the coupling and strap would exit the interior of the container cutout through the side of the container lid.

Figure 7A:
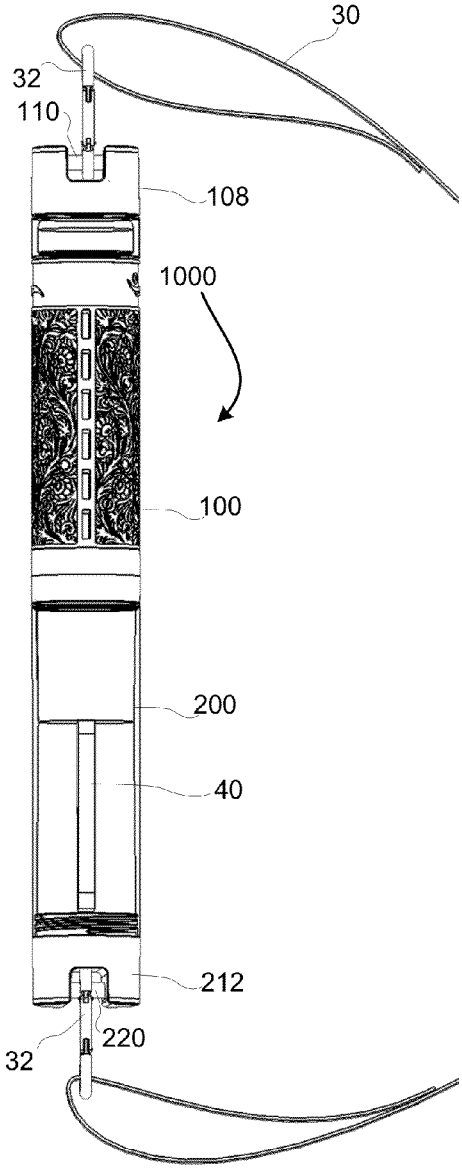
FIGS. 7*a* and 7*b* depicts the preferred embodiment of the core coupled with a strap, in accordance with an embodiment of the invention.
Figure 7B:
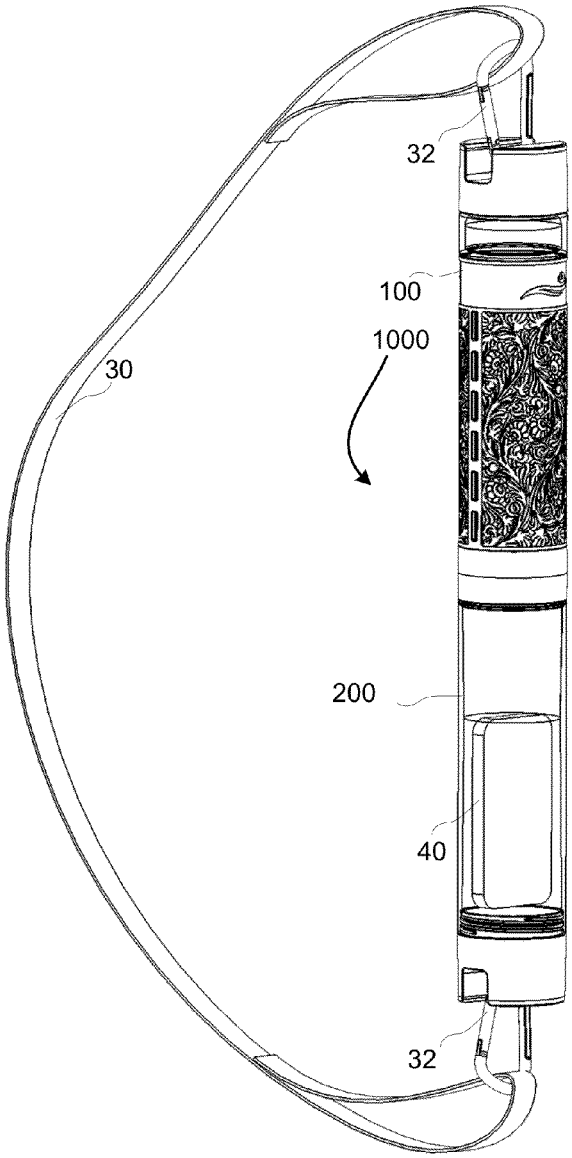

FIGS. 7*a* and 7*b* depicts the preferred embodiment of the core coupled with a strap, in accordance with an embodiment of the invention. Core 1000 includes bottle section 100 and container section 200, which are shown coupled with lids closed. A strap 30 (which is only partially shown in FIG. 7*a* but is fully shown in FIG. 7*b*) is joined with the core via a first carabiner 32 at one end of the strap being coupled with bottle connection point 110, and a second carabiner at the other end of the strap being coupled with container connection point 220. A smartphone 40 is depicted as being stored in the container section 200. The core may be transported with the strap used as a carry-strap, by slinging the core over a person's shoulder, for example. Of note is that the threaded neck, container threads, and reverse-threaded coupling between the bottle section and container section are threadably matched such that, when the lids are closed, the posts are in a substantially parallel orientation to one another to prevent twisting or kinking of the strap when coupled to the lids. In other words, the threads of the pieces are measured and fabricated to end at points designed to stop (i) the bottle lid, (ii) container lid, and (iii) the bottle section versus the container section from rotating any further than a point at which the posts of the bottle and container lids will be parallel to one another.

Figure 7C:
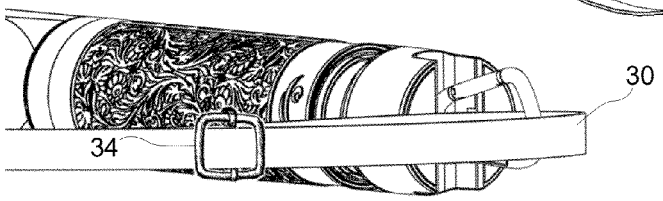
FIG. 7*c* is an isometric cutaway view of a portion of the core and strap, in accordance with an embodiment of the invention.

FIG. 7*c* is an isometric cutaway view of a portion of the core and strap, in accordance with an embodiment of the invention. In some embodiments, the strap includes one or more buckles 34. The one or more buckles facilitate adjustment of the length of the strap. Adjusting the strap may make the strap more comfortable when carrying the core. Alternatively, lengthening or shortening the strap may facilitate use of the strap as a yoga stretching strap when not used for carrying the core.

Figure 8A:
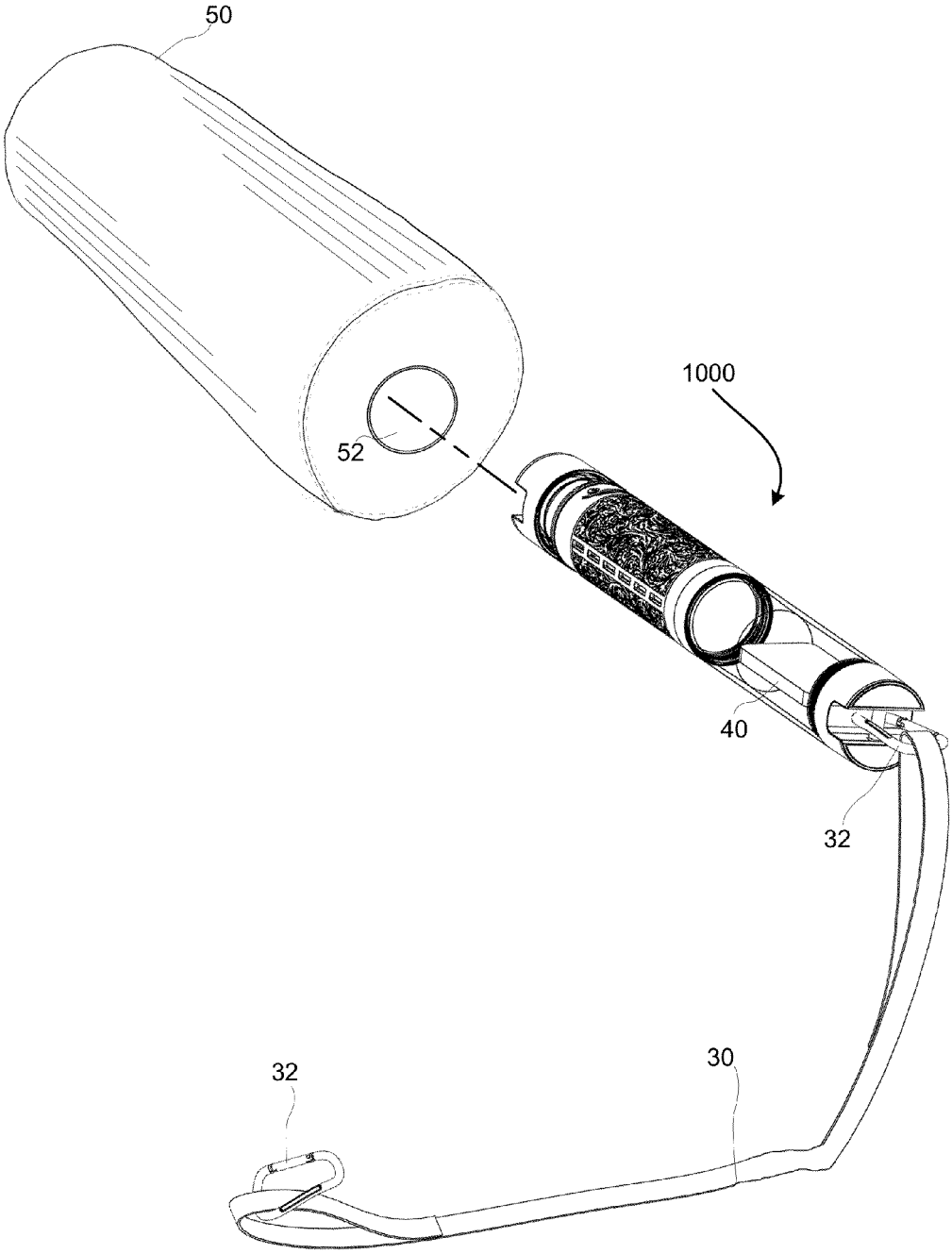
FIG. 8*a* is an isometric view of a system including a core, a strap, and a bolster, in accordance with an embodiment of the invention.

FIG. 8*a* is an isometric view of a system including a core, a strap, and a bolster, in accordance with an embodiment of the invention. Bolster 50 may be similar to a bolster used for support during certain yoga moves, for example. In some embodiments, the bolster may have a hollow channel 52 disposed from one end of the bolster to the other. The bolster may be partially supported internally by a framework for maintaining the bolster's shape under pressure. The framework may be made of plastic which is rigid or semi-rigid. The bolster may be otherwise filled with cushioning material, such as buckwheat hulls. In some embodiments, the hollow channel 52 is sized to receive the core 1000. That is, the diameter of the channel is substantially the same as the core's outer diameter, varying enough to securely accommodate insertion of the core into the channel while not letting the core move around inside the bolster without some force. In some embodiments, the bolster is substantially the same length as the core. In different embodiments, the bolster may be one or two inches longer or shorter than the core. The core may be inserted into the bolster's channel until the face of the lid is flush with the side of the bolster. Carabiner 32 of the strap 30 may be attached to the core either before or after the core is inserted into the bolster. In some embodiments, the one or more carabiners are removable from the strap. Alternatively, the carabiners may be left attached to the connection points of the core, and the strap may be separated from the carabiners so that that loops of the strap for receiving the carabiners may be used in yoga stretching poses (i.e. placing hands, feet and/or other body parts through the loops).

Figure 8B:
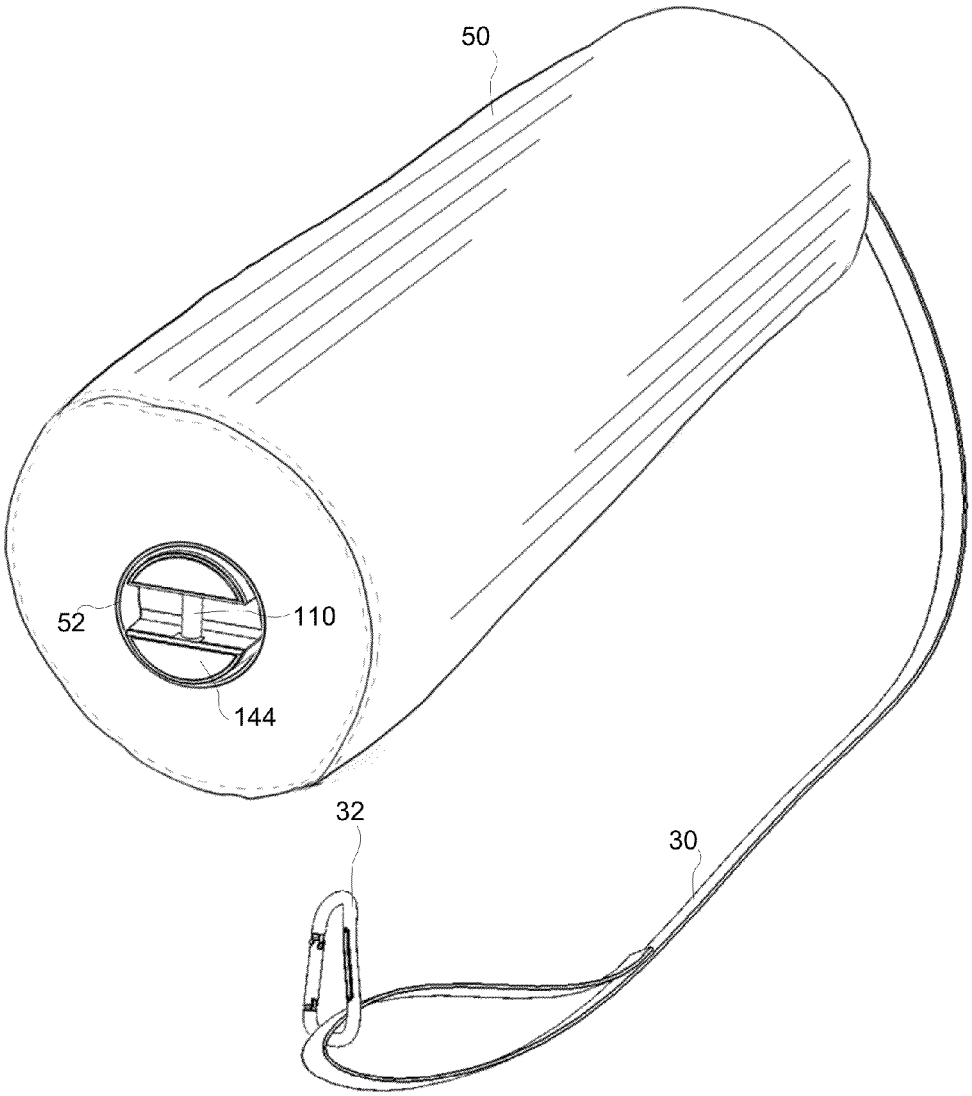
FIG. 8*b* is another isometric view of the system including the core, the strap, and the bolster, in accordance with the embodiment of the invention.

FIG. 8*b* is another isometric view of the system including the core, the strap, and the bolster, in accordance with the embodiment of the invention. In FIG. 8*b*, the core has been inserted through channel 52 of bolster 50. The top face of the bottle lid 144 is visible at the end of the channel. The strap 30, which is still connected to the core at the container end on the other side of the bolster, may be connected to the core via carabiner 32 being clipped to bottle connection point 110. Once the strap is connected to the core on both sides of the bolster, the system may be slung over a shoulder by the strap for easy transport. Buckles of the strap may be used to adjust the length of the strap for carrying.

Figure 9A:
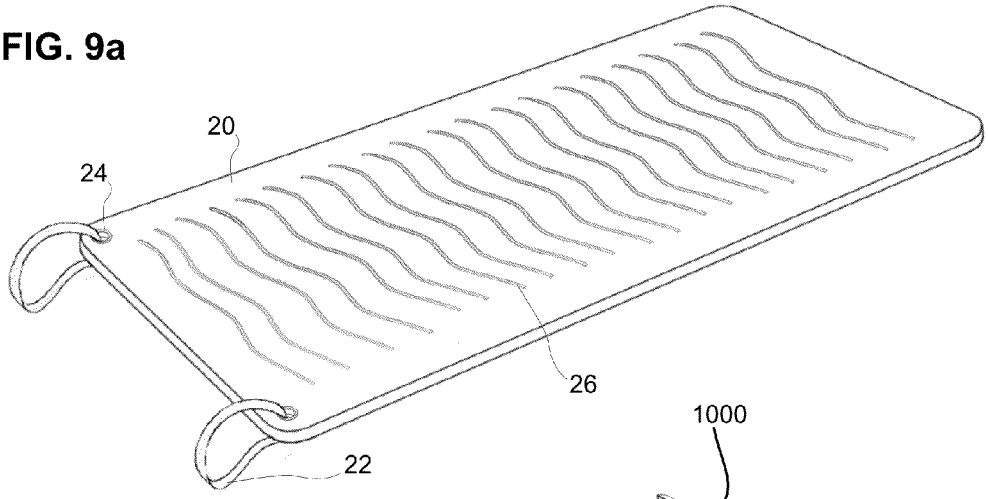
FIG. 9*a* is an isometric view of an exercise mat, in accordance with an embodiment of the invention.

FIG. 9*a* is an isometric view of an exercise mat, in accordance with an embodiment of the invention. In some embodiments, the exercise mat 20 may be a yoga mat. In some embodiments, the mat may have a width substantially equal (plus or minus two inches) to the length of the core to facilitate the core being used to form a perfect roll of the mat and to facilitate coupling of a strap to the ends of the core with the mat rolled around it. A width of the mat substantially equal to the length of the core ensures the flat top of the bottle lid and the flat top of the container lid are flush with the edges of the mat rolled up around the core, providing access to the core's connection points for coupling the strap to the core.

The mat may be constructed of rubber or a rubber-like substance which facilitates the mat being rolled. A grip feature may be included on the mat, such as the wavy indentations 26 depicted in FIG. 9*a*. The grip feature may be useful to keep the mat from sliding on a surface on which the mat is laid (i.e. a "gripping surface" of the mat). It may also keep a towel in contact with the mat from slipping during hot yoga, for example. Finally, when the mat is rolled around the core, the grip feature may prevent the core from spinning around the when rolled inside of the mat through frictional bias, the friction being between the gripping surface of the mat and the glass and/or plastic circumference of the core. The grip feature may be included on one or both sides of the mat.

The mat has one or more grommets 22 through which one or more elastic straps 24 are threaded. In a preferred embodiment, two grommets are located near (within six inches) the corners of one end of the mat. The grommets protect the mat so that the elastic bands do not chafe the mat. The grommets also may help a user determine which end of the mat to lay towards the front of the room, for example. In some embodiments, the elastic strap or straps are a continuous elastic strap or straps. In different embodiments, the strap is a piece of fabric which is may be tied together upon the mat being rolled. In other embodiments, the strap is a bungee cord.

In the preferred embodiment, the two elastic bands are tensioned such that they securely retain the core inside the mat upon the mat being rolled up around the core and the bands are wrapped around the mat. The elastic bands will stretch under tension to be substantially the circumference of the rolled-up mat with the core inside, substantially referring to the slight squeezing of the elastic bands exerted on the rolled-up mat, which may slightly reduce the circumference of the mat underneath the bands and/or further secure the core inside the center of the rolled-up mat. In some embodiments, the one or more elastic bands are tensioned to securely retain a bolster with an inserted core inside of a mat rolled around the bolster. In some embodiments, the one or more elastic bands are tensioned to securely retain a bolster with an inserted core inside of a towel and mat rolled around the bolster.

Figure 9B:
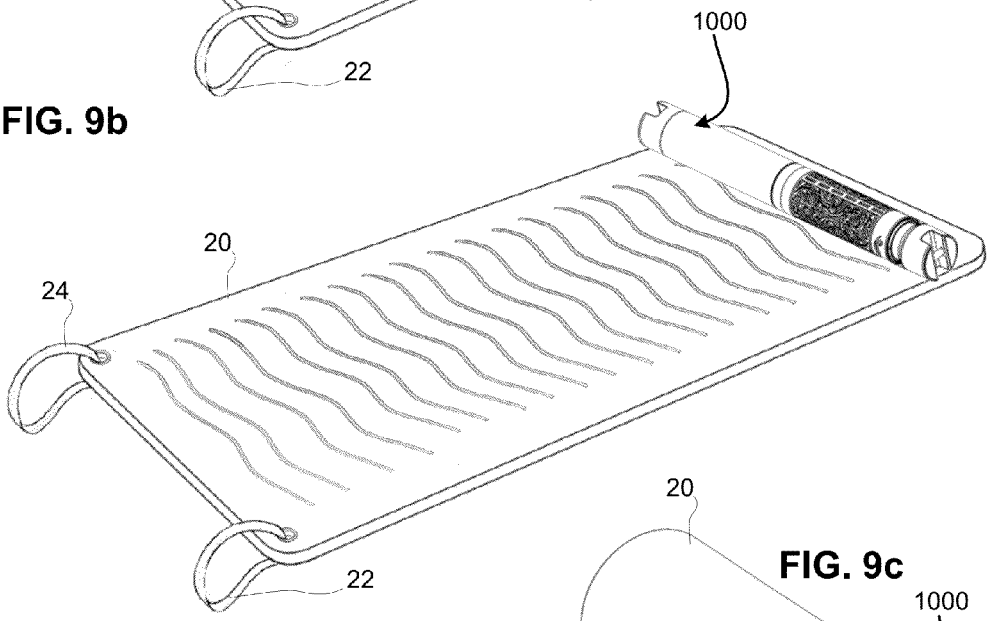
FIG. 9*b* is another isometric view of the exercise mat, in accordance with an embodiment of the invention.

FIG. 9*b* is another isometric view of the exercise mat, in accordance with an embodiment of the invention. In FIG. 9*b*, the core 1000 has been placed on top of the mat. The core has been placed opposite the side of the mat from the grommets 24 and elastic bands 22. The core is now in position to aid in easily rolling the mat about the core in a perfectly-wound roll. Some users may prefer to lay a towel on the mat and lay the core on top of the towel, in order to roll both the towel and mat about the core. In some embodiments, the core may be inserted into the bolster, the bolster with inserted core may be laid on top of the towel and mat, and the bolster with inserted core may be used to aid in easily rolling the mat about the core in a perfectly-wound roll.

Figure 9C:
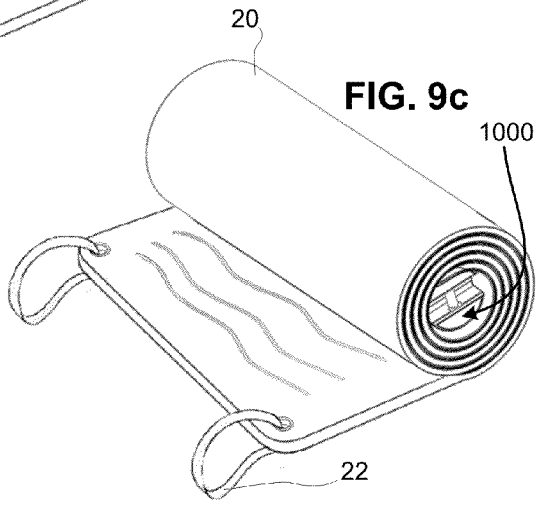
FIG. 9*c* is another isometric view of the exercise mat, in accordance with an embodiment of the invention.

FIG. 9*c* is another isometric view of the exercise mat, in accordance with an embodiment of the invention. In FIG. 9*c*, the majority of the mat 20 has been rolled around core 1000. Upon reaching the end of the mat with the roll, elastic bands 22 may be stretched around the rolled mat.

Figure 10A:
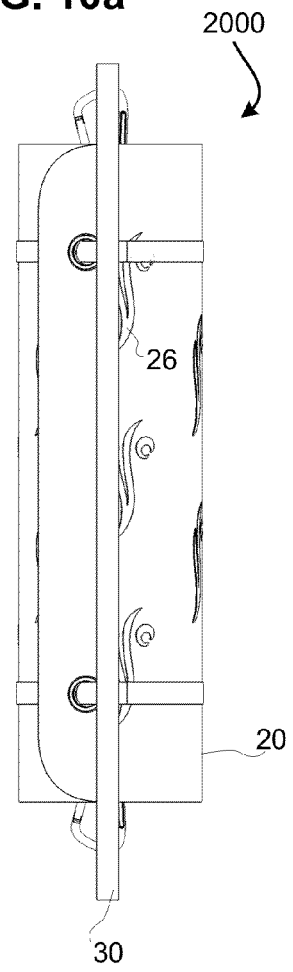
FIGS. 10*a*, 10*b*, and 10*c* are a top view, a side view, and an isometric view of an all-in-one yoga system, in accordance with an embodiment of the invention.
Figure 10B:
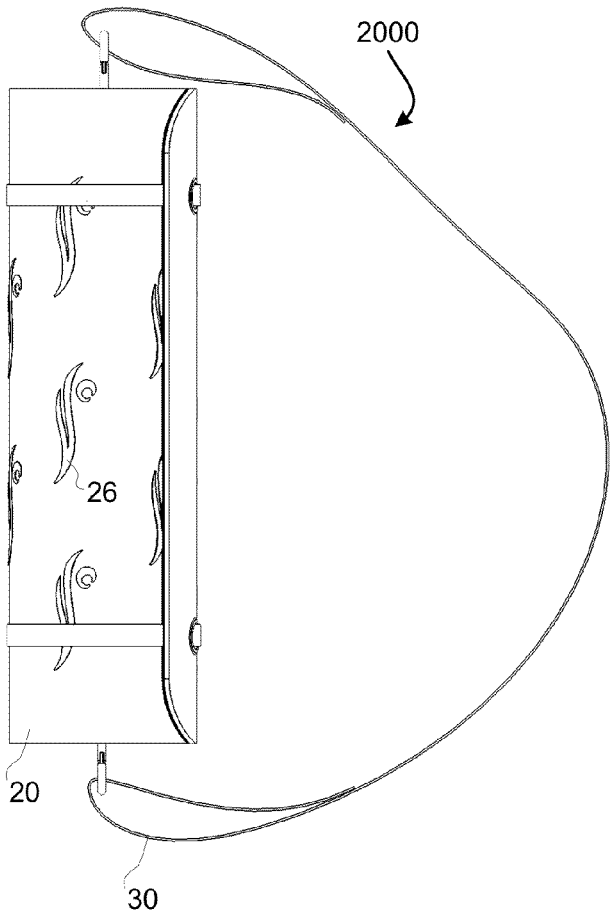
Figure 10C:
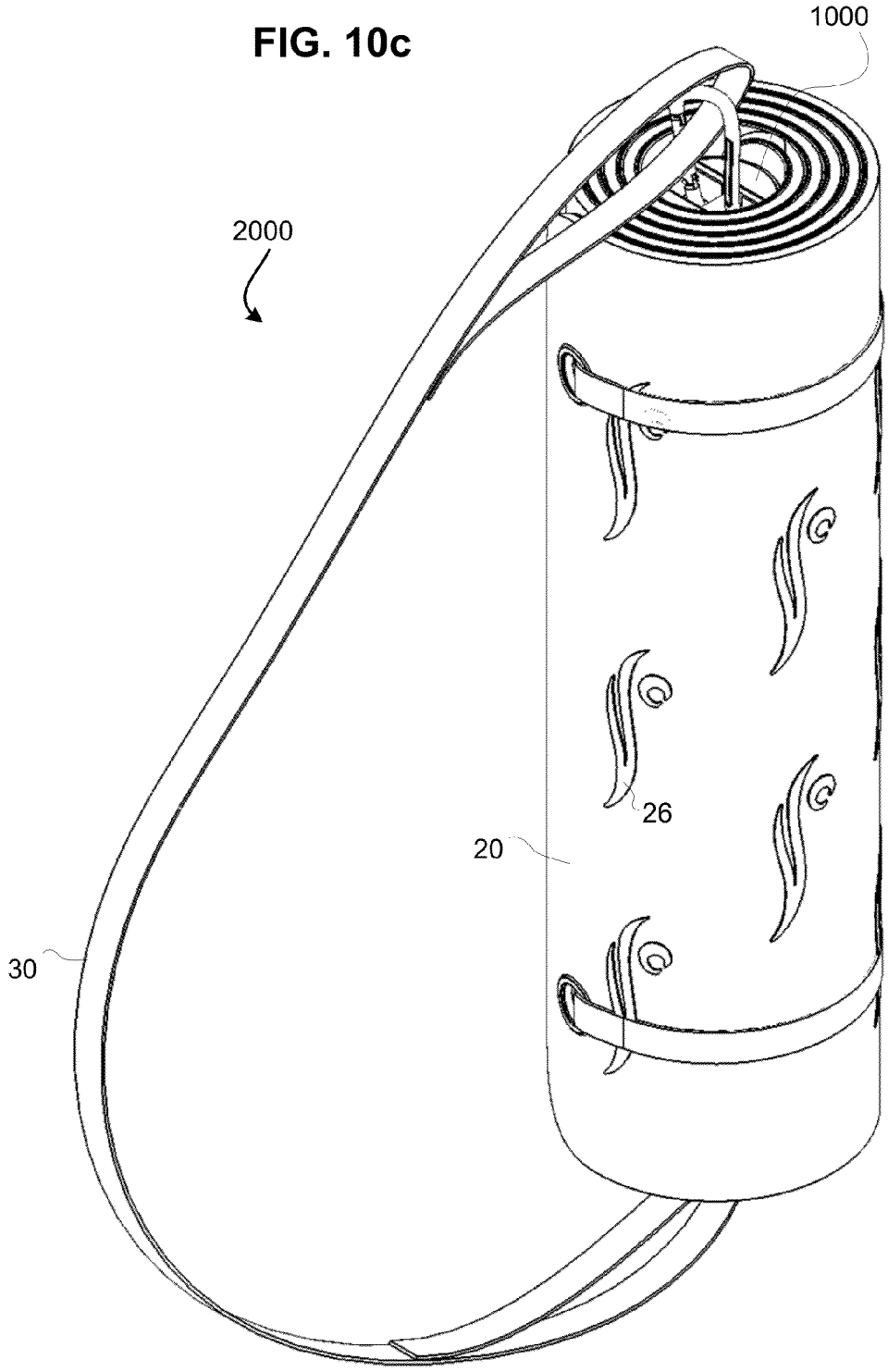

FIGS. 10*a*, 10*b*, and 10*c* are a top view, a side view, and an isometric view of an all-in-one yoga system, in accordance with an embodiment of the invention. In some embodiments, an all-in-one yoga system 2000 includes a core 1000, a mat 20, and a strap 30. Mat 20 is depicted in FIGS. 10*a* through 10*c* as having a grip feature 26 on the outside of the rolled-up mat. In some embodiments the roll is maintained via elastic bands about the rolled-up mat.

In different embodiments, the mat may have a different type of fastener, such as a fabric tab extending from an end of the mat. The fabric tab may have one half of a hook-and-loop style closure sewn to it, with the other half of the closure coupled with the underside of the mat. In other embodiments, there may be a fabric hook adhered to the underside of the mat, where the fabric tab (upon the mat being rolled) may pass between the fabric hook and the underside of the mat and then fold over on itself. The folded fabric tab may couple to itself via a snap, a hook-and-loop style closure, or another means of coupling the fabric tab.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A system, comprising:

a core, the core including at least a bottle section and a container section, the bottle section and container section couplable to define a cylinder;

a mat, the mat including at least one elastic band threaded through at least one grommet of the mat; and a strap, the strap including at least one coupling disposed at each end of the strap, wherein the at least one elastic band is tensioned to securably retain the core inside the mat upon the mat being rolled up around the core, and wherein a first coupling of the strap is couplable with a first end of the core and a second coupling of the strap is couplable with a second end of the core.

2. The system of claim 1, wherein the strap comprises:

the strap including at least one buckle, the at least one buckle facilitating adjustment of length of the strap.

3. The system of claim 1, further comprising:

a towel, wherein the at least one elastic band is tensioned to securably retain the core inside the towel and the mat upon the towel and the mat being rolled up around the core.

4. The system of claim 1, further comprising:

a bolster, wherein the at least one elastic band is tensioned to securably retain the core inside the bolster and the mat upon the core being inserted in the bolster and the mat being rolled up around the bolster.

5. The system of claim 1, further comprising:

a towel; and a bolster, wherein the at least one elastic band is tensioned to securably retain the core inside the bolster, the towel and the mat upon the core being inserted in the bolster and the towel and mat being rolled up around the bolster.

6. The system of claim 1, wherein the core comprises:

the core including at least a length of the cylinder equal to or less than the width of the mat.

7. The system of claim 1, wherein the core comprises:

the bottle section and the container section longitudinally couplable to define a cylinder about a longitudinal axis through a length of the bottle section and container section.

8. The system of claim 1, wherein the core comprises:

the bottle section including at least a bottle and a bottle lid threadably couplable with the bottle, the bottle lid including at least a flat top and a bottle connection point; and the container section including at least a container and a container lid threadably couplable with the container, the container lid including at least a flat top and a container connection point, wherein the flat top of the bottle lid is substantially flush with a rolled first edge of the mat upon the mat being rolled up around the core, and wherein the flat top of the container lid is substantially flush with a rolled second edge of the mat upon the mat being rolled up around the core.

9. The system of claim 8, wherein a length of the core between the flat top of the bottle lid and the flat top of the container lid is substantially the same as the width of the mat when the bottle section and container section are coupled.

10. The system of claim 8, wherein, upon the bottle section and container section being coupled and the mat being rolled up around the core, the first coupling of the strap is coupled with the bottle connection point and the second coupling of the strap is coupled with the container connection point to define an all-in-one yoga system.

11. The system of claim 1, wherein the bottle section comprises:

a bottle; and a bottle lid, the bottle lid including at least a bottle connection point, wherein the first coupling of the strap is couplable with the first end of the core at the bottle connection point.

12. The system of claim 1, wherein the strap comprises:

the strap including at least one coupling removably disposed at each end of the strap.

13. The system of claim 1, wherein the core comprises:

the core including at least a bottle section and a container section, the bottle section and container section reverse-threadably couplable to define the cylinder.

14. The system of claim 13, wherein the core comprises:

the bottle section including at least a bottle and a bottle lid threadably couplable with the bottle; and the container section including at least a container and a container lid threadably couplable with the container.

15. The system of claim 14, wherein the bottle is openable via the bottle lid being turned counter-clockwise relative to the bottle when viewed from above the bottle lid, the container is openable via the container lid being turned counter-clockwise relative to the container when view from above the container lid, and the bottle section and container section are separable via the bottle section and container section being turned clockwise relative to one another.

16. The system of claim 1, wherein the mat comprises:

the mat including a gripping surface, the gripping surface providing frictional bias to the core upon the mat being rolled up around the core.

17. The system of claim 1, wherein the bottle section comprises:

a bottle, the bottle made substantially of glass;

a bottle lid threadably couplable with the bottle; and a connector coupled with the bottle, the connector coupled at an end of the bottle opposite from the bottle lid, the connector made of a non-glass material, the connector facilitating absorption of shock to the bottle section resulting from the bottle section impacting a hard surface.

18. The system of claim 1, wherein the core comprises:

the bottle section and the container section having a substantially constant diameter along a length of the core.

19. An all-in-one yoga system, comprising:

a core, the core having a substantially constant diameter along a length of the core, the core including at least:

a bottle;

a bottle lid, the bottle lid threadably couplable with the bottle, the bottle lid including at least a flat top and a bottle connection point;

a container;

a container lid, the container lid threadably couplable with the container, the container lid including at least a flat top and a container connection point;

a connector, the connector fixedly coupled with an end of the bottle opposite the bottle lid, the connector configured for reverse-threadably receiving the container at an end of the container opposite the container lid;

a mat, the mat having a width substantially equal to the length of the core, the mat including at least:

one or more grommets disposed at one end of the mat; and one or more continuous elastic bands threaded through the one or more grommets, the one or more elastic bands tensioned to securably retain the core inside the mat upon the mat being rolled up around the core and the one or more elastic bands being wrapped around the rolled up mat; and a strap, the strap including at least:

one or more couplings disposed at each end of the strap; and at least one buckle, the at least one buckle facilitating adjustment of the length of the strap, wherein, when the bottle lid is threadably coupled with the bottle, the container lid is threadably coupled with the container, the container section is reverse-threadably received by the bottle section, the mat is rolled up around the core, and the one or more elastic bands are wrapped around the rolled up mat, at least one coupling of the strap is couplable with the bottle connection point and at least one other coupling of the strap is couplable with the container connection point.

20. An all-in-one yoga system, comprising:

a core including at least a couplable bottle and container;

a mat including at least a fastener, wherein the fastener is operable to securably retain the core within the mat upon the mat being rolled around the core; and an adjustable-length strap, the adjustable-length strap being couplable with a first end of the core and a second end of the core.

* * * * *